US006078772A

United States Patent [19]

Takaya et al.

[11] Patent Number: 6,078,772

[45] Date of Patent: Jun. 20, 2000

[54] IMAGE-FORMING APPARATUS

[75] Inventors: Toshihiko Takaya, Yamatokoriyama; Fumio Shimazu; Seiichi Yoshida, both of Nara; Hideki Ohnishi; Tomohiro Oikawa, both of Chiba; Yoshie Iwakura, Nara, all of Japan

[73] Assignee: Sharp Kabushiki Kaisha, Osaka, Japan

[21] Appl. No.: 08/938,618

[22] Filed: Sep. 26, 1997

[30] Foreign Application Priority Data

| | | | |
|---|---|---|---|
| Sep. 27, 1996 | [JP] | Japan | 8-256988 |
| Sep. 27, 1996 | [JP] | Japan | 8-256996 |
| Sep. 24, 1997 | [JP] | Japan | 9-258954 |

[51] Int. Cl.[7] ..... G03G 15/14

[52] U.S. Cl. ..... 399/297; 399/303

[58] Field of Search ..... 399/297, 303, 399/299, 306, 314, 316; 430/126

[56] References Cited

U.S. PATENT DOCUMENTS 5,390,012 2/1995 Miyashiro et al. .

FOREIGN PATENT DOCUMENTS 2-74975 3/1990 Japan .
5-313512 11/1993 Japan .
5-84902 12/1993 Japan .
53-23835 12/1993 Japan .

*Primary Examiner*—Richard Moses

[57] ABSTRACT

An image-forming apparatus is provided with: a photoconductor drum having a surface on which a toner image is formed, a transfer drum for transferring the toner image onto a copying material by allowing the copying material to contact the photoconductor drum, and a ground roller for electrostatically attracting the copying material onto the transfer drum prior to transferring the toner image onto the copying material. He transfer drum is constituted by a semi-conductive layer and a dielectric layer that are stacked on a conductive layer. [Supposing that] The nip width between the photoconductor drum and the transfer drum is L1, the rotation speed of the two drums is Vp, and the time constant, which is represented by a product of the resistance and the capacitance between the two drums, is $\tau$, the relationship represented by $L1/Vp<\tau$ is satisfied. By defining the time constant of the transfer drum [as described above], it becomes possible to stabilize an electric field made by the transfer drum, and consequently to carry out a desired transferring operation.

18 Claims, 26 Drawing Sheets

IMAGE-FORMING APPARATUS

FIELD OF THE INVENTION

The present invention relates to an image-forming apparatus used for example for a laser printer, a copying machine, a laser facsimile, a composite apparatus of these machines.

BACKGROUND OF THE INVENTION

In a conventional image-forming apparatus, an electrostatic latent image, which is formed on a photoconductor drum and to which toner adheres, is developed, and the resulting toner image is copied onto a copying material that has been wrapped onto a transfer drum.

For example, as illustrated in FIG. 27, such an image-forming apparatus has corona charger 102 for attracting a copying material P and corona charger 104 for transferring a toner image formed on the surface of a photoconductor drum 103 onto the copying material P, which are separately installed inside a cylinder 101 having a dielectric layer 101*a*. Thus, the attracting process and the copying process for the copying material P are carried out separately by the respective chargers 102 and 104.

Further, as illustrated in FIG. 28, some image-forming apparatuses are provided with a cylinder 201 having a two-layer structure of a semiconductive layer 201*a* (an outer layer) and a base layer 201*b* (an inner layer) and a grip mechanism 202 for holding the transported copying material P along the cylinder 201. In this type of image-forming apparatus, the grip mechanism 202 grips the transported copying material P at its end and wraps it along the surface of the cylinder 201, and then the surface of the cylinder 201 is charged by applying a voltage to the semiconductive layer 201*a* forming the outer layer of the cylinder 201 or allowing the charger installed inside the cylinder 201 to discharge so that the toner image on the photoconductor drum 103 is copied onto the copying material P.

In the image-forming apparatus as shown in FIG. 27, however, since the cylinder 101 serving as a transfer roller has a one-layer structure with only the dielectric layer 101*a*, it needs to have the above-mentioned corona chargers 102 and 104 installed inside thereof. This limits the size of the cylinder 101, and the resulting problem is that it is difficult to make the apparatus compact.

Moreover, in the image-forming apparatus as shown in FIG. 28, since the cylinder 201 serving as a transfer roller is designed to have the two-layer structure so that it is readily charged so as to copy the toner image onto the copying material P, it is possible to reduce the number of chargers. However, the application of the grip mechanism 202 makes the entire construction of the image-forming apparatus more complex, resulting in an increase in the number of parts in the entire apparatus and an increase in the manufacturing costs of the apparatus.

In order to solve the above-mentioned problem, for example, Japanese Laid-Open Patent Publication No. 74975/1990 (Tokukaihei 2-74975) discloses an image-forming apparatus wherein: a transfer drum, constituted by conductive rubber and a dielectric film that are laminated on a metal roll that is grounded, is provided and a corona charger, which is driven by a unipolar power supply, is installed in the vicinity of the separation position of the copying material associated with the transfer drum. In this image-forming apparatus, an electric charge is induced on the dielectric film by the corona charger so as to allow the transfer drum to attract the copying material. Here, as the copying material is attracted, more electric charge is induced, making it possible to carry out a copying process.

Therefore, with the above-mentioned image-forming apparatus, since a single charger charges the surface of the transfer drum, allows the copying material to be attracted, and carries out the copying process, it is possible to make the transfer drum compact. Further, without the need for the grip mechanism 202 or other devices for holding the copying material, it is possible to attract the copying material by using a simple structure.

Moreover, Japanese Laid-Open Patent Publication No. 173435/1993 (Tokukaihei 5-173435) and U.S. Pat. No. 5390012 disclose copying apparatuses in which: a transfer drum having at least an elastic layer made of a foamed material and a dielectric layer covering the elastic layer is provided and toner images with respective colors successively formed on the photoconductive drum are successively overlapped and transferred onto a copying material that has been attracted onto the transfer drum so that a color image is formed on the copying material.

In these copying apparatuses, with respect to a method for holding the copying material on the transfer drum, the copying material is electrostatically attracted onto the transfer drum by using an attracting roller that serves as an electric-charge applying means. Moreover, between the elastic layer and the dielectric layer in the transfer drum, a clearance not less than 10 $\mu$m is provided so that electric charge is accumulated on the back surface (the side not having the copying material) of the dielectric layer so as to make a construction in which electric potential is maintained without being affected by environmental conditions. Thus, the attracting capability, that is, attracting property of the copying material, is improved.

Furthermore, Japanese Examined Patent Publication No. 84902/1993 (Tokukouhei 5-84902) discloses a multiple copying apparatus having a construction which is provided with a transfer drum for transferring a toner image formed on the photoconductor drum onto a copying material at a transferring position. On the transfer drum, a dielectric layer with a thickness of 70 to 200 $\mu$m, which has a dielectric constant of 3.0 to 13.0 and a critical surface tension of not more than 40 dyne/cm, is stacked. The electric characteristics of such a dielectric layer make it possible to maintain transferring performances even under severe environmental and ambient conditions, and the critical surface tension ensures the cleaning property of the surface of the transfer drum after separation of the copying material.

Additionally, with respect to cleaning mechanisms for an intermediate transfer belt on which a toner image, formed on the photoconductor drum, is temporarily overlapped and transferred prior to being transferred onto a copying material, for example, Japanese Laid-Open Patent Publication No. 323835/1993 (Tokukaihei 5-323835) discloses a method for combinedly using a brush and a blade, and Japanese Laid-Open Patent Publication No. 313512/1993 (Tokukaihei 5-313512) discloses a method in which after eliminating electricity from the surface of the intermediate transferring belt using a brush, the surface is cleaned by a blade.

However, since the surface of the transfer drum is charged through an atmospheric discharge by a corona charger, the construction described in Japanese Laid-Open Patent Publication No. 74975/1990 (Tokukaihei 2-74975) is susceptible to the effects of environmental conditions, such as temperatures, moisture, etc. of the air, resulting in unevenness in the surface electric potential of the transfer drum.

Consequently, this construction tends to have disadvantages such as insufficient attraction of the copying material and degradation in print quality. Further, if the surface of the transfer drum has scratches, the electric-field region will become smaller upon charging by an atmospheric discharge, and the transferring electric-field balance tends to be disordered at the scratched portions. Therefore, a transferring process, if carried out in such portions, tends to cause defects in transfer such as white blanks, resulting in degradation in the picture quality.

The constructions respectively described in Japanese Laid-Open Patent Publication No. 173435/1993 (Tokukaihei 5-173435) and U.S. Pat. No. 5,390,012 have the following disadvantages: In general, it is considered that, if different kinds of copying material are used, since the amount of electric charge of the copying material is different within a given period of time (nip time) during which the copying material passes between the transfer drum and the attracting roller, the transferring electric field upon electrostatic transfer from the photoconductor drum to the copying material differs to a great degree depending on the kinds of copying material. In other words, if the nip time is set constant in any kind of copying material, since the amount of electric charge injected within the constant time differs depending on the kinds of copying material, the electrostatic transferring capability of the transfer drum is reduced depending on the kinds of copying material, with the result that electrostatic transfer occasionally is not available by the photoconductor drum. The resulting problem is that a toner image, formed on the photoconductor drum, is not properly transferred onto the copying material.

Further, if the nip time is set constant in the same manner as described above, the electrostatic attracting capability of the transfer drum is reduced depending on the kinds of copying material, resulting in failure to properly attract the copying material onto the transfer drum. Consequently, the copying material tends to peel from the transfer drum and a toner image, formed on the photoconductor drum, is not properly transferred onto the copying material.

Moreover, after separation of the copying material, the copying-material attracting charge, the counter charge of toner, etc., still exist on the surface of the transfer drum, and in the case of a strong electric constraining force of the toner adhering to the surface of the transfer drum, the cleaning property tends to be altered. The tendency is particularly strong in the case of toner with high electric resistance. When the cleaning property is altered as described above and the toner on the surface of the transfer drum becomes difficult to remove therefrom, the resulting problems are contamination of the back surface of the copying material and difficulty in carrying out the next attracting and transferring operations.

Here, from the point of view of cleaning mechanisms and static-eliminating mechanisms for the transfer drum and the intermediate transfer belt, any of the above-mentioned conventional constructions is merely a modification of a method used for the image-bearing body such as a photoconductor drum and a photoconductor belt, and fails to provide an optimum mechanism for the transfer drum. Consequently, for example, the attracting electric potential for attracting the copying material becomes unstable due to unnecessary electric charges which remain on the transfer drum after cleaning, resulting in problems, such as separation of the copying material from the dielectric layer during transportation, dislocation thereof, and the subsequent degradation in the picture quality.

The unnecessary charges after cleaning correspond to the sum of frictional electrification caused when the blade in the cleaning mechanism sweeps the surface of the transfer drum and the counter charge of toner.

SUMMARY OF THE INVENTION

The first objective of the present invention is to provide an image-forming apparatus wherein by defining time constants in a transfer section, the transfer section is allowed to provide a stable electric field so that a desired transferring operation is available.

The second objective of the present invention is to provide an image-forming apparatus wherein by giving consideration to the construction of a transfer section having a dielectric layer for electrostatically attracting a copying material and defining time constants in a transfer section, unnecessary electric charges, which remain on the surface of the transfer section after cleaning, can be eliminated without separately providing a static-eliminating device or other device so that the picture quality is improved with constantly stable paper-attracting property.

In order to achieve the first objective, the first image-forming apparatus of the present invention is provided with: an image-bearing body having a surface on which a toner image is formed, a transfer section for transferring the toner image formed on the image-bearing body onto a copying material by allowing the copying material to contact the image-bearing body, the transfer section being constituted by a dielectric layer that is stacked on a conductive base, and an attracting section for electrically attracting and holding the copying material onto the transfer section prior to transferring the toner image onto the copying material, the attracting section being placed on the periphery of the transfer section, wherein supposing that the width of a contact portion formed by the contact between the image-bearing body and the transfer section is represented by L, the surface velocity of the image-bearing body and the transfer section is represented by Vp and the time constant of the transfer section, which is represented by a product of the resistance and the capacitance between the image-bearing body and the transfer section, is $\tau$, the relationship represented by $L/Vp<\tau$ is satisfied.

With the above-mentioned arrangement, when a voltage is applied from the conductive base side of the transfer section or the attracting section side resulting in an electric potential difference between the two sections, a charge is induced in the dielectric layer by an electric field (referred to as an attracting and holding electric field) between the attracting section and the transfer section so that the copying material is electrostatically attracted onto the dielectric layer. Then, the copying material thus attracted is transported following the rotation of the transfer section to reach the contact portion between the image-bearing body and the transfer section at which it contacts the image-bearing body so that the toner image is transferred onto the copying material by an electric field (referred to as a transferring electric field) generated between the image-bearing body and the transfer section, and then the copying material is separated from the transfer section.

At this time, the relationship represented by $L/Vp<\tau$ is satisfied, that is, the time required for the surface of the transfer section to move the width L is set smaller than the time constant $\tau$; therefore, the transfer section is dealt as a dielectric within the width L, thereby making it possible to suppress the movement of the charge.

Therefore, since the transferring electric field at the contact portion is always kept stable, it is possible to prevent a reduction in the electrostatic transferring capability caused by differences in the kinds, thicknesses, etc. of copying material, and consequently to carry out a desired toner-transferring operation.

Further, the above-mentioned arrangement may be modified to form the second image-forming apparatus, which is provided with: an image-bearing body having a surface on which a toner image is formed, an intermediate transfer section on which the toner image formed on the image-bearing body is temporarily electrostatically transferred, the intermediate transfer section being constituted by a dielectric layer that is stacked on a conductive base, and a transfer section for electrostatically transferring the toner image that has been temporarily transferred onto the intermediate transfer section onto a copying material, wherein supposing that the width of a contact portion formed by the contact between the image-bearing body and the intermediate transfer section is represented by L, the surface velocity of the image-bearing body and the intermediate transfer section is represented by Vp and the time constant of the intermediate transfer section, which is represented by a product of the resistance and the capacitance between the image-bearing body and the intermediate transfer section, is $\tau$, the relationship represented by $L/Vp<\tau$ is satisfied.

With the above-mentioned arrangement, when an electric potential difference appears between the intermediate transfer section and the image-bearing body, a charge is induced in the dielectric layer by an electric field (referred to as a toner-holding electric field) between the intermediate transfer section and the image-bearing body so that the toner image is temporarily electrostatically transferred onto the intermediate transfer section. The copying material is, on the other hand, transported between the intermediate transfer section and the transfer section and when it comes into contact with the intermediate transfer section, the toner image is transferred onto the copying material by an electric field (referred to as a transferring electric field) generated between the intermediate transfer section and the transfer section, and then the copying material is separated from the transfer section. Additionally, in the case of a color image, toner images are transferred onto the intermediate transfer section in an overlapped manner, and the overlapped toner images thus transferred may be transferred onto the copying material all at once.

At this time, the relationship represented by $L/Vp<\tau$ is satisfied, that is, the time required for the surface of the intermediate transfer section to move the width L is set smaller than the time constant $\tau$; therefore, the intermediate transfer section is dealt as a dielectric within the width L, thereby making it possible to suppress the movement of the charge.

Therefore, since the toner-holding electric field at the contact portion is always kept stable, it is possible to prevent a reduction in the toner-holding capability caused by differences in the kinds, thicknesses, etc. of copying material, and consequently to carry out a desired toner-transferring operation.

Moreover, the aforementioned arrangement may be modified to form the third image-forming apparatus, which is provided with: an image-bearing body having a surface on which a toner image is formed, a transfer section for transferring the toner image formed on the image-bearing body onto a copying material by allowing the copying material to contact the image-bearing body, the transfer section being constituted by a dielectric layer that is stacked on a conductive base, and an attracting section for electrically attracting and holding the copying material onto the transfer section prior to transferring the toner image onto the copying material, the attracting section being placed on the periphery of the transfer section, wherein supposing that the distance on the transfer section from the transferring position associated with the transfer section to the attracting position associated with the attracting section is represented by L, the surface velocity of the image-bearing body and the transfer section is represented by Vp and the time constant of the transfer section, which is represented by a product of the resistance and the capacitance between the image-bearing body and the transfer section, is $\tau$, the relationship represented by $L/Vp<\tau$ is satisfied.

With the above-mentioned arrangement, in the same manner as the first image-forming apparatus, the copying material is electrostatically attracted onto the transfer section by the attracting and holding electric field, and the toner image is transferred onto the copying material by the transferring electric field.

At this time, the relationship represented by $L/Vp<\tau$ is satisfied, that is, the time required for the surface of the transfer section to move the distance L from the attracting position to the transferring position is set smaller than the time constant $\tau$; therefore, the transfer section is dealt as a dielectric within the distance L, thereby making it possible to suppress the movement of the charge.

Therefore, since the attracting and holding electric field within the distance L is always kept stable, it is possible to prevent a reduction in the electrostatic attracting capability caused by differences in the kinds, thicknesses, etc. of copying material, and consequently to carry out a desired toner-transferring operation.

The aforementioned arrangement may be modified to form the fourth image-forming apparatus, which is provided with: an image-bearing body having a surface on which a toner image is formed, an intermediate transfer section on which the toner image formed on the image-bearing body is temporarily electrostatically transferred, the intermediate transfer section being constituted by a dielectric layer that is stacked on a conductive base, and a transfer section for electrostatically transferring the toner image that has been temporarily transferred onto the intermediate transfer section onto a copying material, wherein supposing that the distance on the intermediate transfer section from the first transferring position at which the toner image is transferred from the image-bearing body onto the intermediate transfer section to the second transferring position at which the toner image is transferred from the intermediate transfer section to the copying material is represented by L, the surface velocity of the image-bearing body and the intermediate transfer section is represented by Vp and the time constant of the intermediate transfer section, which is represented by a product of the resistance and the capacitance between the image-bearing body and the intermediate transfer section, is $\tau$, the relationship represented by $L/Vp<\tau$ is satisfied.

With the above-mentioned arrangement, in the same manner as the second image-forming apparatus, the toner image is temporarily transferred onto the surface of the intermediate transfer section at the first transferring position by the toner-holding electric field, and then the toner image is transferred onto the copying material at the second transferring position by the transferring electric field.

At this time, the relationship represented by $L/Vp<\tau$ is satisfied, that is, the time required for the surface of the intermediate transfer section to move the distance L from the first transferring position to the second transferring position is set smaller than the time constant $\tau$; therefore, the intermediate transfer section is dealt as a dielectric within the distance L, thereby making it possible to suppress the movement of the charge.

Therefore, since the toner-holding electric field within the distance L is kept stable, it is possible to prevent a reduction in the electrostatic attracting capability caused by differences in the kinds, thicknesses, etc. of copying material, and consequently to carry out a desired toner-transferring operation.

The fifth image-forming apparatus of the present invention is provided with: an image-bearing body having a surface on which a toner image is formed, a transfer section for transferring the toner image formed on the image-bearing body onto a copying material by allowing the copying material to contact the image-bearing body, the transfer section being constituted by a dielectric layer that is stacked on a conductive base, and an attracting section for electrostatically attracting and holding the copying material onto the transfer section prior to transferring the toner image onto the copying material, the attracting section being placed on the periphery of the transfer section, wherein supposing that the length of the circumference of the transfer section is represented by L, the surface velocity of the image-bearing body and the transfer section is represented by Vp and the time constant of the transfer section, which is represented by a product of the resistance and the capacitance between the image-bearing body and the transfer section, is $\tau$, the relationship represented by $L/Vp<\tau$ is satisfied.

With the above-mentioned arrangement, in the same manner as the first image-forming apparatus, the copying material is electrostatically attracted onto the transfer section by the attracting and holding electric field, and the toner image is copied onto the copying material by the transferring electric field.

At this time, the relationship represented by $L/Vp<\tau$ is satisfied, that is, the time required for the surface of the transfer section to make one rotation is set smaller than the time constant $\tau$; therefore, the transfer section is dealt as a dielectric within the length L, thereby making it possible to suppress the movement of the charge.

Therefore, since the attracting and holding electric field within the length L is always kept stable, it is possible to prevent a reduction in the electrostatic attracting capability caused by differences in the kinds, thicknesses, etc. of copying material, and consequently to carry out a desired toner-transferring operation.

The sixth image-forming apparatus is provided with: an image-bearing body having a surface on which a toner image is formed, an intermediate transfer section on which the toner image formed on the image-bearing body is temporarily electrostatically transferred, the intermediate transfer section being constituted by a dielectric layer that is stacked on a conductive base, and a transfer section for electrostatically transferring the toner image that has been temporarily transferred onto the intermediate transfer section onto a copying material, wherein supposing that the length of the circumference of the intermediate transfer section is represented by L, the surface velocity of the image-bearing body and the intermediate transfer section is represented by Vp and the time constant of the intermediate transfer section, which is represented by a product of the resistance and the capacitance between the image-bearing body and the intermediate transfer section, is $\tau$, the relationship represented by $L/Vp<\tau$ is satisfied.

With the above-mentioned arrangement, in the same manner as the second image-forming apparatus, the toner image is temporarily transferred onto the intermediate transfer section by the toner-holding electric field, and then the toner image is transferred onto the copying material by the transferring electric field.

At this time, the relationship represented by $L/Vp<\tau$ is satisfied, that is, the time required for the surface of the intermediate transfer section to make one rotation is set smaller than the time constant $\tau$; therefore, the intermediate transfer section is dealt as a dielectric within the length L, thereby making it possible to suppress the movement of the charge.

Therefore, since the toner-holding electric field within the length L is kept stable, it is possible to prevent a reduction in the toner-holding capability caused by differences in the kinds, thicknesses, etc. of copying material, and consequently to carry out a desired toner-transferring operation.

The seventh image-forming apparatus of the present invention is provided with: an image-bearing body having a surface on which a toner image is formed, a transfer section for transferring the toner image formed on the image-bearing body onto a copying material by allowing the copying material to contact the image-bearing body, the transfer section being constituted by a dielectric layer that is stacked on a conductive base, and a cleaning section for removing residual toner from the surface of the transfer section after the toner image has been transferred onto the copying material, the cleaning section being placed on the periphery of the transfer section, wherein supposing that the distance on the transfer section from the transferring position associated with the transfer section to the cleaning position associated with the cleaning section is represented by L, the surface velocity of the image-bearing body and the transfer section is represented by Vp and the time constant of the transfer section, which is represented by a product of the resistance and the capacitance between the image-bearing body and the transfer section, is $\tau$, the relationship represented by $L/Vp>\tau$ is satisfied.

With the above-mentioned arrangement, in the same manner as the first image-forming apparatus, the copying material is electrostatically attracted onto the transfer section by the attracting and holding electric field, and after the toner image has been transferred onto the copying material by the transferring electric field, the cleaning section removes residual toner.

At this time, the relationship represented by $L/Vp>\tau$ is satisfied, that is, the time required for the surface of the transfer section to move the distance L from the transferring position to the cleaning position is set greater than the time constant $\tau$; therefore, unnecessary charges continue to weaken along the distance L, and when the residual toner has reached the cleaning section, the toner adhering force is merely made up of an opposing charge and a physical adhering force.

Therefore, it is possible to easily carry out a toner cleaning operation using the cleaning section, and consequently to prevent toner from remaining on the surface of the transfer section. Thus, it becomes possible to carry out a desired toner transfer in the next transferring operation.

The eighth image-forming apparatus of the present invention is provided with: an image-bearing body having a surface on which a toner image is formed, an intermediate transfer section on which the toner image formed on the image-bearing body is temporarily electrostatically transferred, the intermediate transfer section being constituted by a dielectric layer that is stacked on a conductive base, a transfer section for electrostatically transferring the toner image that has been temporarily transferred onto the intermediate transfer section onto a copying material, and a cleaning section for removing residual toner from the surface of the intermediate transfer section after the toner image has been transferred onto the copying material, the cleaning section being placed on the periphery of the intermediate transfer section, wherein supposing that the distance on the intermediate transfer section from the transferring position at which the toner image is transferred from the image-bearing body to the intermediate transfer section to the cleaning position associated with the cleaning section is represented by L, the surface velocity of the image-bearing body and the intermediate transfer section is represented by Vp and the time constant of the intermediate transfer section, which is represented by a product of the resistance and the capacitance between the image-bearing body and the intermediate transfer section, is $\tau$, the relationship represented by $L/Vp>\tau$ is satisfied.

With the above-mentioned arrangement, in the same manner as the second image-forming apparatus, the toner image is temporarily transferred onto the surface of the intermediate transfer section at the transferring position by the toner-holding electric field, and thereafter the toner image is copied onto the copying material by the transferring electric field, and the cleaning section removes residual toner.

At this time, the relationship represented by $L/Vp>\tau$ is satisfied, that is, the time required for the surface of the intermediate transfer section to move the distance L from the transferring position to the cleaning position is set greater than the time constant $\tau$; therefore, unnecessary charges continue to weaken along the distance L, and when the residual toner has reached the cleaning section, the toner adhering force is merely made up of an opposing charge and a physical adhering force.

Therefore, it is possible to easily carry out a toner cleaning operation using the cleaning section, and consequently to prevent toner from remaining on the surface of the transfer section. Thus, it becomes possible to carry out a desired toner transfer in the next transferring operation.

In order to achieve the aforementioned second objective, the ninth image-forming apparatus of the present invention is provided with: an image-bearing body having a surface on which a toner image is formed, a transfer section, constituted by a dielectric layer that is stacked on a conductive base, for transferring the toner image formed on the image-bearing body onto a copying material by allowing the copying material electrostatically attracted onto the dielectric layer to contact the image-bearing body during the rotation thereof, an attracting section for electrostatically attracting the copying material onto the dielectric layer, the attracting section being placed on the upstream side of the transferring position on the periphery of the transfer section, and a cleaning section for removing residual toner from the surface of the transfer section after separation of the copying material, the cleaning section being placed on the downstream side of the transferring position on the periphery of the transfer section, wherein supposing that the distance on the circumferential surface of the transfer section from the cleaning position associated with the cleaning section to the attracting position associated with the attracting section is represented by L, the surface velocity of the image-bearing body and the transfer section is represented by Vp and the time constant of the transfer section, which is represented by a product of the resistance and the capacitance between the image-bearing body and the transfer section, is $\tau$, the relationship represented by $L/Vp>\tau$ is satisfied.

With the above-mentioned arrangement, in the same manner as the first image-forming apparatus, the copying material is electrostatically attracted onto the transfer section by the attracting and holding electric field, and after the toner image has been copied onto the copying material by the transferring electric field, the copying material is separated from the transfer section. After separation of the copying material, residual toner on the surface of the transfer section is removed by the cleaning section at the cleaning position, and then the transfer section again reaches the attracting position at which the next copying material is electrostatically attracted thereon.

At this time, the relationship represented by $L/Vp>\tau$ is satisfied, that is, the time required for a given point on the surface of the transfer section (the circumferential surface), which has been subject to a cleaning operation by the cleaning section, to move the distance L to reach the attracting position is set greater than the time constant $\tau$; therefore, unnecessary charges remaining on the transfer section continue to weaken along the distance L to the attracting position, and when it has reached the attracting section, there remains only the predetermined charge that is exerted by the attracting and holding electric field generated between the attracting section and the transfer section.

Therefore, it is possible to always stabilize the attracting electric potential, and consequently to stably attract the copying material onto the dielectric layer in the transfer section. Thus, it becomes possible to prevent disadvantages such separation of the copying material from the transfer section and dislocation thereof during transportation.

Moreover, it is more preferable for the above-mentioned first through ninth image-forming apparatuses to have at least a layer of an elastic resistor that is placed between the conductive base and the dielectric layer in the transfer section.

With this arrangement, since the elastic resistor layer, formed on the back-surface (the surface facing the elastic resistor layer) side of the dielectric layer, provides a higher cushion property, it is possible to suppress degradation of the dielectric layer due to contact between the transfer section and the image-bearing body and contact between the transfer section and the attracting section, and also to allow an easy adjustment of the nip width that can be carried out by a pressing force.

Furthermore, it is more preferable for the above-mentioned first through ninth image-forming apparatuses to have at least a layer of an elastic resistor that is placed between the conductive base and the dielectric layer in the transfer section, and also to have a clearance formed between the elastic resistor layer and the dielectric layer.

With this arrangement, in addition to the cushion property exerted by the elastic resistor layer as described earlier, when an electric potential difference appears between the transfer section and the attracting section, a discharge phenomenon occurs in the clearance formed between the elastic resistor layer and the dielectric layer, and the discharge results in a charge on the back surface of the dielectric layer so that a strong attracting force is exerted to the copying material. Therefore, it is possible to further stabilize the attracting operation for the copying material, and consequently to attract the copying material more stably onto the dielectric layer in the transfer section.

For a fuller understanding of the nature and advantages of the invention, reference should be made to the ensuing detailed description taken in conjunction with the accompanying drawings.

DESCRIPTION OF THE EMBODIMENTS

EMBODIMENT 1

Referring to FIGS. 1 through 18 the following description will discuss the first embodiment of the present invention.

Figure 2:
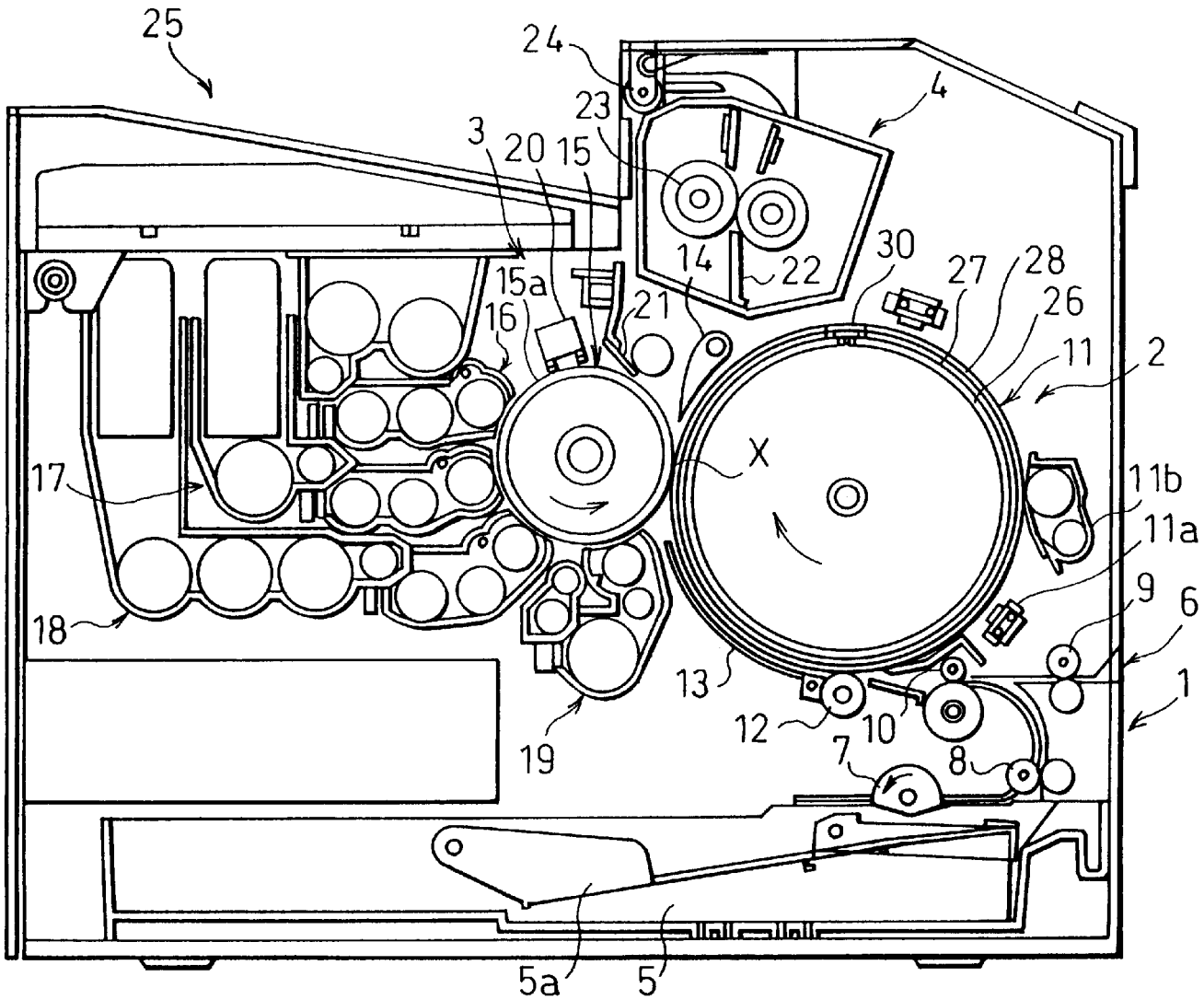
FIG. 2 is a view showing the construction of the image-forming apparatus having the transfer drum.

As illustrated in FIG. 2, the image-forming apparatus of the present embodiment is constituted by a paper-feed section 1 for storing and feeding copying materials P (see FIG. 11) on which an image is formed by toner, a transfer section 2 for transferring the toner image onto the copying material P, a developing section 3 for forming the toner image, and a fixing section 4 for fusing and fixing the toner image that has transferred onto the copying material P.

The paper-feed section 1 has a paper-feed cassette 5 that is removably attached to the lowest portion of the apparatus main body and that stores the copying materials P so as to feed them to the transfer section 2, and a manual-feed section 6 which is placed on the front of the apparatus main body and from which the copying materials P are manually fed one by one from the front side. The paper-feed section 1 is also provided with a pick-up roller 7 for sending out the copying materials P one by one from the top section of the paper-feed cassette 5, a pre-feed roller (a PF roller) 8 for transporting the copying material P sent out by the pick-up roller 7, a manual-feed roller 9 for transporting the copying material P fed from the manual-feed section 6, and a pre-curl roller 10 for allowing the copying material P that has been transported by the PF roller 8 and the manual-feed roller 9 to curl.

A send-out member 5*a*, which is urged upward by a spring or other members, is installed in the paper-feed cassette 5, and the copying materials are stored on the send-out member 5*a*. Thus, the copying materials P, the top of which is allowed to contact the pick-up roller 7, are sent out one by one to the PF roller 8 through the rotation of the pick-up roller 7 in a direction indicated by the arrow, and transported to the pre-curl roller 10.

On the other hand, the copying material P that has fed from the manual-feed section 6 is also transported to the pre-curl roller 10 by the manual-feed roller 9. As described earlier, the pre-curl roller 10 allows the transported copying material P to curl, and this is carried out so that the copying material P can be easily attracted onto the surface of a cylindrical transfer drum 11 that is installed in the transfer section 2.

The transfer drum (a transfer means) 11 is installed in the transfer section 2. On the periphery of the transfer drum 11, a ground roller 12 (an attracting means) that is grounded and that is used for electrostatically attract the copying material P onto the transfer drum 11, a guide member 13 for guiding the attracted copying material P so as not to drop from the transfer drum 11, and an exfoliative claw 14 for forcefully scrape scraping of the attracted copying material P from the transfer drum 11. The construction of the transfer drum 11 will be described later.

Further, on the periphery of the transfer drum 11, a cleaning device (a cleaning means) 11*b*, which works on the transfer drum 11 after the copying material P has been scraped from the transfer drum 11 so as to remove residual toner adhering to the transfer drum 11, is also installed. Thus, the transfer drum 11 is cleaned before the next copying material P is attracted so that the attracting process for the next copying material P is carried out stably and it becomes possible to prevent the back side of the copying material P from being contaminated.

Moreover, on the periphery of the transfer drum 11, a static-eliminating device 11*a*, which works on the transfer drum 11 after the toner has been removed from the cleaning device 11*b* and eliminates a residual charge remaining after the application of charge to the transfer drum 11 upon scraping the copying material P or other processes, is also installed. The static-eliminating device 11*a* is installed on the upstream side of the ground roller 12. Thus, the transfer drum 11 is free from the residual charge, and the attracting process for the next copying material P is carried out stably. Here, by setting the electric potential after the separation of the copying material P at a reference level, it becomes possible to make the transferring electric field stable upon the next transferring process.

Moreover, in the developing section 3, a photoconductor drum (an image-bearing body) 15 that comes into contact with the transfer drum 11 is installed. The photoconductor drum 15 is constituted by a conductive aluminum base cylinder 15*a* that is grounded, and its surface is coated with an OPC (Organic Photo Semiconductor) film 15*b* (see FIG. 8). In this case, besides OPC, Se may be used.

Further, on the periphery of the photoconductor drum 15 are placed in a radial manner, developing devices 16, 17, 18 and 19 that respectively house yellow, magenta, cyan and black toners, a charger 20 for charging the surface of the photoconductor drum 15 and a cleaning blade 21 for scraping and removing residual toner from the surface of the photoconductor drum 15. Thus, a toner image is formed on the photoconductor drum 15 for each toner.

The photoconductor drum 15 and the transfer drum 11 are pressed onto each other so that a pressure of 8 kg is applied at transferring position X so as to attain proper transferring efficiency and image quality. Here, a corona charger is generally used as the charger 20; however, a charging-use roller may also be used.

Moreover, in the fixing section 4, a fixing roller 23 for fixing the toner image onto the copying material P by fusing it under predetermined temperature and pressure and a fixing guide 22 for guiding the copying material P that has been scraped by the scraping claw 14 from the transfer drum 11 toward the fixing roller 23 are installed. On the downstream side of the fixing section 4 in the copying-material transporting direction, an ejection roller 24 is installed so that the copying material P, after having been fixed, is ejected from the apparatus main body onto a tray 25.

The image-forming apparatus, which has the above-mentioned arrangement, is operated as follows:

First, in the case of automatic feeding, copying materials P are fed to the PF roller 8 one by one by the pick-up roller 7 in succession from the top thereof from the paper-feed cassette 5 installed in the lowest portion of the apparatus main body. Then, the copying material P, which has passed through the PF roller 8, is allowed to curl by the pre-curl roller 10 along the shape of the transfer drum 11.

On the other hand, in the case of manual feeding, copying materials P are fed one by one from the manual-feed section 6 installed on the front of the apparatus main body, and the copying material P is transported to the pre-curl roller 10 by the manual roller 9. Thus, the copying material P is allowed to curl along the shape of the transfer drum 11.

Next, the copying material P that has been curled by the pre-curl roller 10 is transported between the transfer drum 11 and the ground roller 12. Then, a charge is induced on the surface of the copying material P by the charge induced on the surface of the transfer drum 11. Consequently, the copying material P is electrostatically attracted onto the surface of the transfer drum 11.

In this case, charging, exposing, developing and transferring operations are repeated by the photoconductor drum 15 for each color. Therefore, in the case of color copying, with respect to the copying material P that has been electrostatically attracted on the transfer drum 11, each time the transfer drum 11 rotates once, a toner image with one color is transferred onto the copying material P, making it possible to obtain a color image at a maximum of four rotations. Here, in the case of black-and-white image or mono-color images, the transfer drum 11 is rotated only once.

Thereafter, the copying material P, attracted onto the transfer drum 11, is transported to transferring position X which forms the pressing section between the transfer drum 11 and the photoconductor drum 15, and the toner image is copied onto the copying material P by the electric potential difference between the charge of toner formed on the photoconductor drum 15 and the charge on the surface of the copying material P.

After all the toner images have been copied onto the copying material P, the copying material P is forcefully scraped from the surface of the transfer drum 11 by the scraping claw 14 that is placed on the circumference of the transfer drum 11 so as to freely come into contact therewith, and directed to the fixing guide 22.

Then, the copying material P is guided toward to the fixing roller 23 by the fixing guide 22, and the toner image on the copying material P is fused and fixed onto the copying material P by the temperature and pressure of the fixing roller 23. Thereafter, the copying material P that has been fixed is ejected onto the tray 25 by the ejection roller 24.

The following description will discuss the construction of the transfer drum 11.

Figure 3:
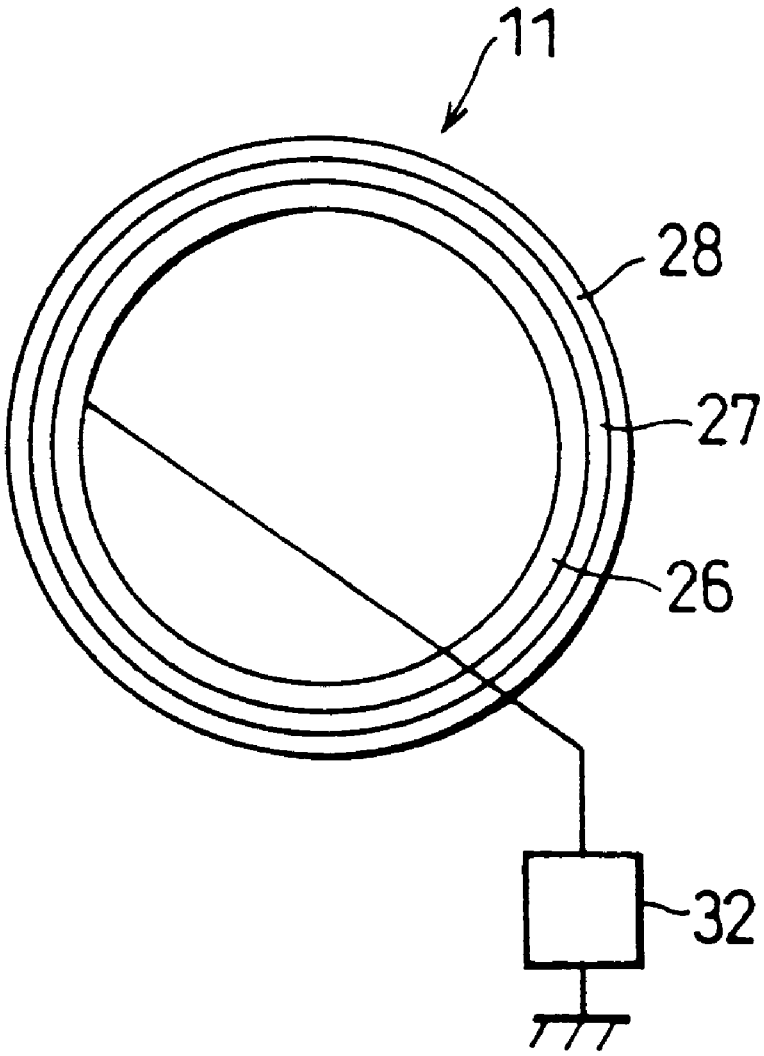
FIG. 3 is a view showing the construction of the transfer drum.

As illustrated in FIG. 3, the transfer drum 11 has a cylindrical aluminum conductive layer (a conductive base) 26 as a base member, and a semiconductive layer 27 and a dielectric layer 28 are stacked on the upper surface in this order. Further, a power supply 32 is connected to the conductive layer 26 so as to apply a voltage, with the result that a stable voltage is maintained around the conductive layer 26.

The semiconductive layer 27 is made of foamed urethane (foamed elastic resistor) to which conductive fine particles (0.1 to 10 μm), such as carbon, are blended by 5 to 30 percent by weight; thus, the surface of the transfer drum 11 is allowed to have a cushion property, and since the foamed material is used, innumerable fine recesses are formed in the surface so that the void is provided between the semiconductive layer 27 and the dielectric layer 28. When a voltage is applied to the conductive layer 26 of the transfer drum 11 so that an electric potential difference appears against the aforementioned ground roller 12, a discharge phenomenon appears in the void, and this discharge raises a charge on the back surface (the surface facing the semiconductive layer 27) of the dielectric layer 28, resulting in a strong attracting force to the copying material P.

The dielectric layer 28 is made up of a PVDF (polyvinylidene fluoride) sheet, and after having been squeezed out into a thickness of approximately 50 to 250 μm, it is formed by setting it into a fixed-form mold and baking it under heat.

Figure 4:
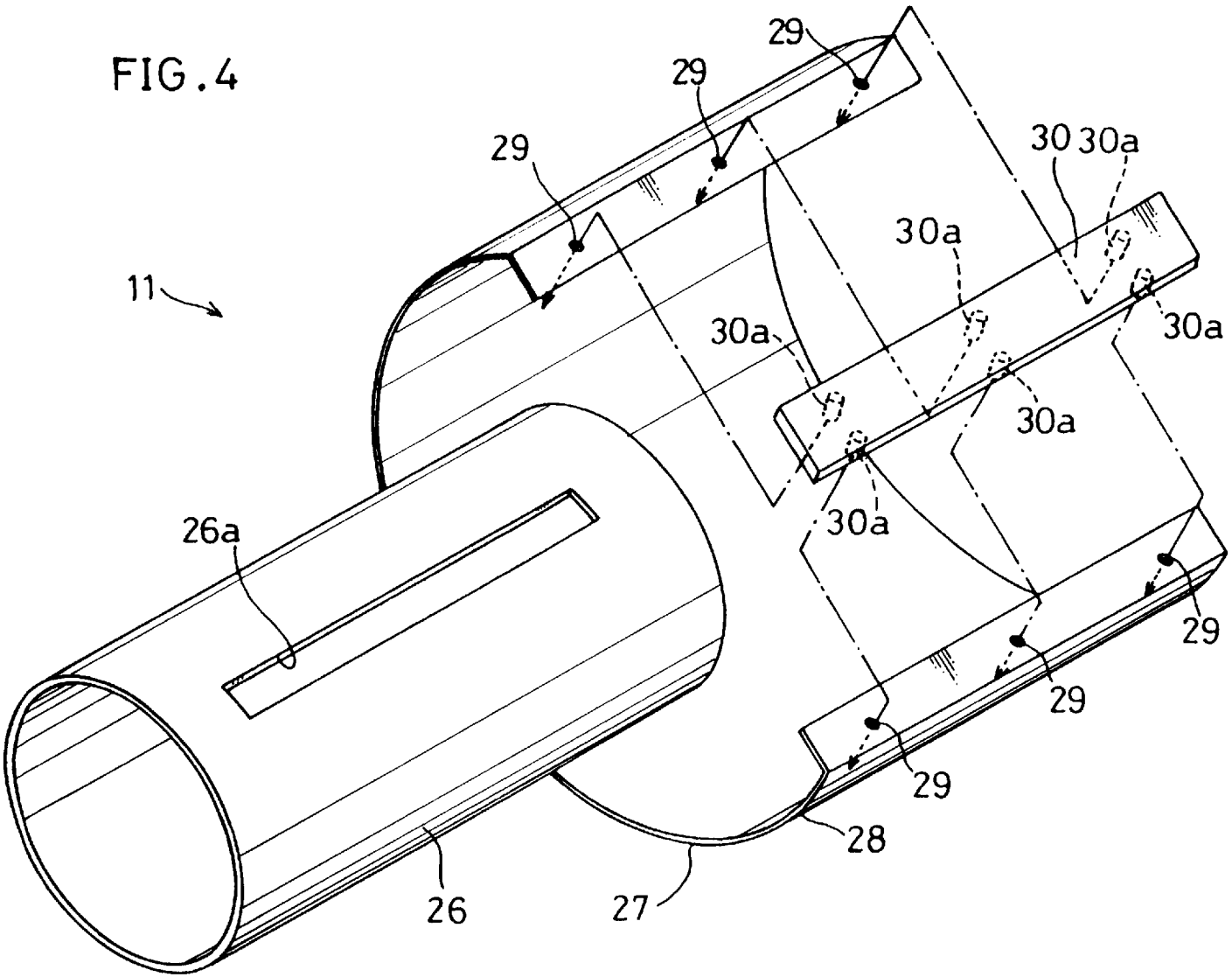
FIG. 4 is an explanatory drawing that shows a connecting state between a conductive layer and a sheet-shaped semi-conductive layer as well as a dielectric layer.

The respective layers 26, 27 and 28 are not bonded by a bonding agent, etc., but, for example, as illustrated in FIG. 4, bosses 30*a*, formed in a sheet-pressing plate 30, are fitted to a plurality of penetrating holes 29 that are formed in both of the ends of the semiconductive layer 27 and the dielectric layer 28, both of which have a sheet shape so as to penetrate the respective layers; moreover, the bosses 30*a* are further fitted to an opening section 26*a* formed in the upper face of the conductive layer 26; thus, the semiconductive layer 27 and the dielectric layer 28 are secured to the conductive layer 26.

In the above-mentioned fixing method, the semiconductive layer 27 and the dielectric layer 28 place a tension toward the inside of the conductive layer 26 through the sheet-pressing plate 30 so that the rise and slack of the respective layers are prevented. By using a fixing method of this type, the void, which is formed by the recesses in the surface of the semiconductive layer 27 between the semiconductive layer 27 and the dielectric layer 28, are positively better maintained as compared with, for example, an arrangement using a bonding agent, etc, for fixing the two layers.

Figure 5:
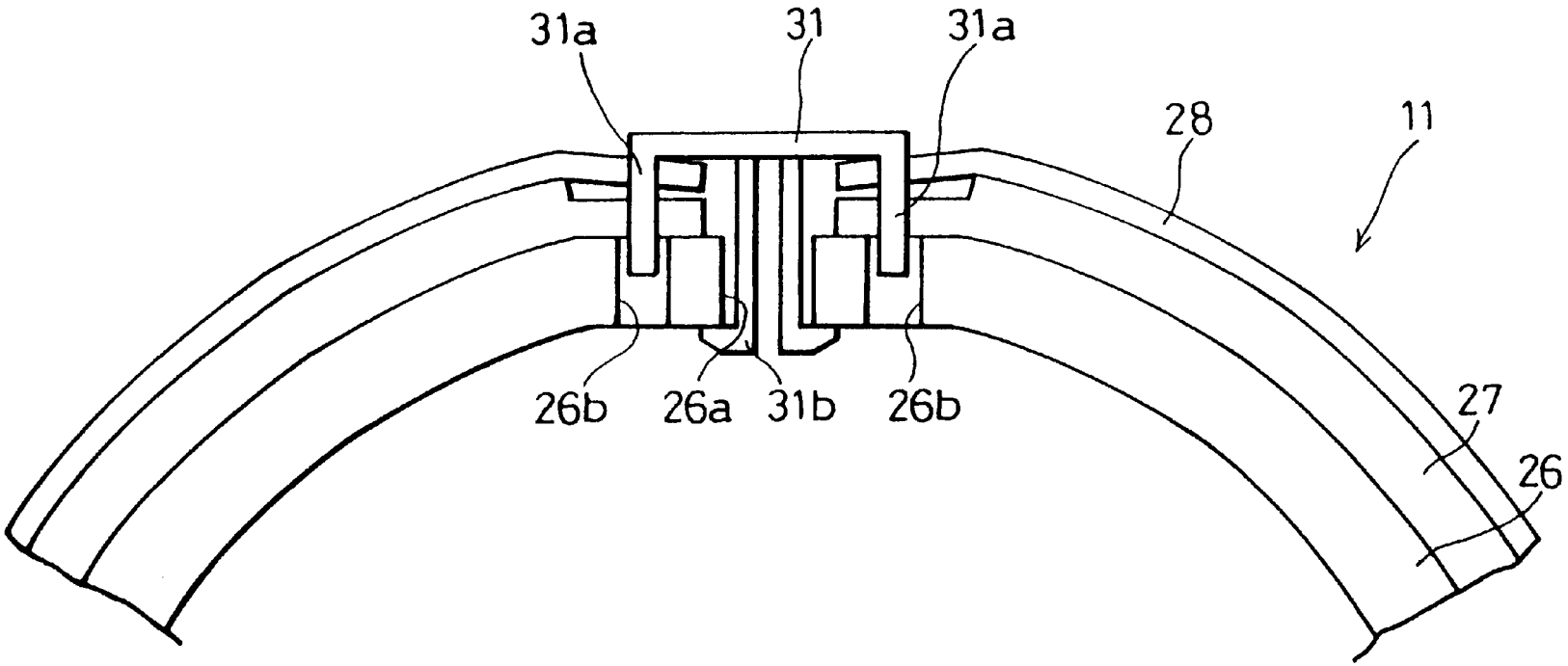
FIG. 5 is another explanatory drawing that shows the connecting state between the conductive layer and the semiconductive layer as well as the dielectric layer.

Further, in addition to the above-mentioned fixing method, for example, as illustrated in FIG. 5, another method is proposed, wherein a sheet-pressing member 31, which has bosses 31*a* on both of its ends and has a fixing member 31*b* in its center, is used to fix the sheets consisting of the semiconductive layer 27 and the dielectric layer 28 to the conductive layer 26. In this fixing method, the bosses 31*a* of the sheet-pressing member 31 are attached to fitting holes 26*b* formed in both sides of the opening 26*a* of the conductive layer 26, and the fixing member 31*b* of the sheet-pressing member 31 is inserted into the opening 26*a* so that the sheets consisting of the semiconductive layer 27 and the dielectric layer 28 are fixed to the conductive layer 26.

In addition to the above-mentioned methods, with respect to a method for fixing the dielectric layer 28 and a semiconductive layer 27 while maintaining the void, a sheet, which forms the dielectric layer 28, may be pressed and inserted onto the semiconductive layer 27 that is made of a foamed material.

The respective layers 26, 27 and 28 may, of course, be bonded by a bonding agent, etc. However, in the case when, in particular, the semiconductive layer 27 and the dielectric layer 28 are fixed by a bonding agent, since the void is filled with the bonding agent, the resulting disadvantage is that it is difficult to maintain the void when the recesses in the surface of the foamed material constituting the semiconductive layer 27 are very fine. In contrast, in the case when the surface of a foamed material constituting the semiconductive layer 27 is rough and the void becomes too large, although a better attracting property is obtained, disturbance in the electric field occurs at the transferring position, resulting in disadvantages in which the transferring property becomes unstable and the images become disturbed. In this case, the void may be filled with a bonding agent to a certain extent. Further, in the case of a fixing method using a bonding agent, a conductive bonding agent in which carbon is dispersed is preferably used to bond the conductive layer 26 and the semiconductive layer 27. Here, the surface roughness of the semiconductive layer 27 can be found based on JIS·B0601 as is disclosed in U.S. Pat. No. 5390012.

Figure 6:
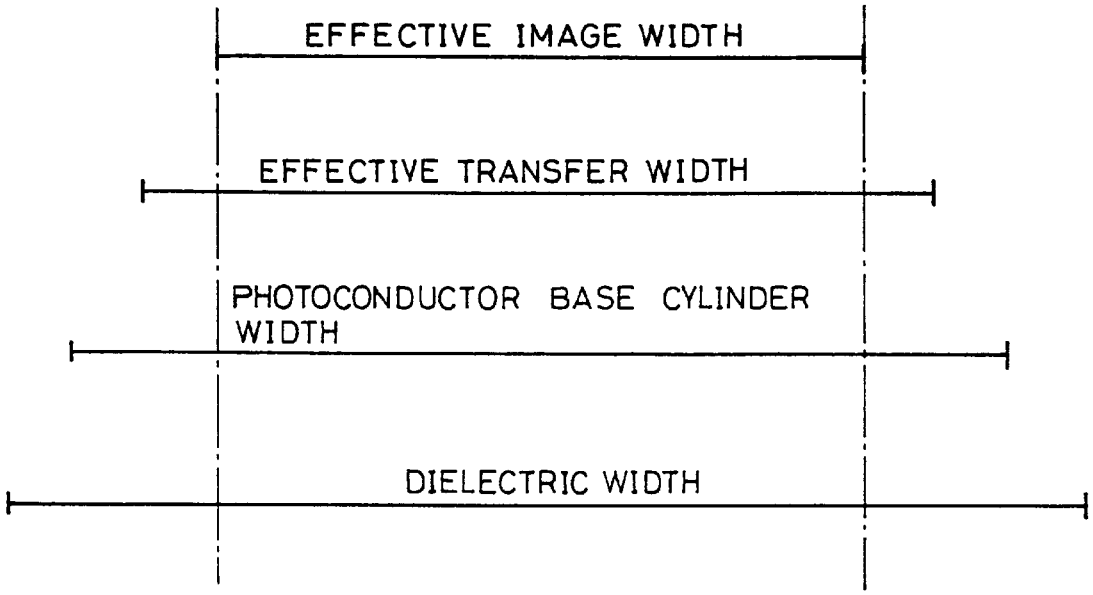
FIG. 6 is an explanatory drawing that compares the width of charge and the effective image width of the transfer drum.

As illustrated in FIG. 6, the width of the dielectric layer 28 of the transfer drum 11 is set wider than the photoconductor base cylinder (the aluminum base cylinder 15*a*) that forms the photoconductor drum 15, the width of the photoconductor base cylinder is set wider than the effective transfer width, and the effective transfer width is set wider than the effective image width (the coating width of the OPC film 15*b*).

Figure 7:
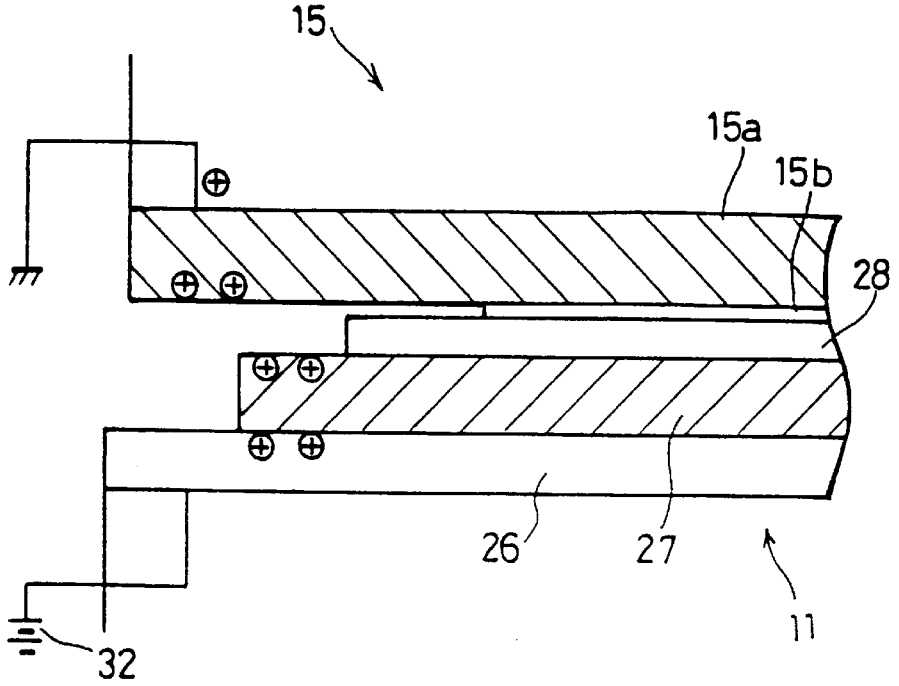
FIG. 7, which shows the charge transfer between the transfer drum and the photoconductor drum, is an explanatory drawing that shows a charge transfer in the case when the widths of the respective layers of the transfer drum is represented by the dielectric layer<the semiconductive layer<the conductive layer.

This is because when the widths of the respective layers of the transfer drum 11 are formed so as to satisfy this relationship; that is, the conductive layer 26>the semiconductive layer 27>the dielectric layer 28 as shown in FIG. 7, the semiconductive layer 27 might come into contact with the aluminum base cylinder 15*a* of the photoconductor drum 15 that is grounded.

In other words, when a positive voltage is applied to the conductive layer 26 by the power supply 32, a positive charge is induced in the conductive layer 26, and the positive charge moves to the surface of the semiconductive layer 27. At this time, if the semiconductive layer 27 comes into contact with the aluminum base cylinder 15*a* of the photoconductor drum 15 that is grounded, all the charge of the semiconductive layer 27 is moved to the aluminum base cylinder 15*a*, with the result that no negative charge is induced on the surface of the dielectric layer 28. For this reason, the transfer drum 11 fails to attract toner with a negative charge that has been attracted onto the OPC film 15*b*, resulting in failure to carry out a copying operation.

Figure 8:
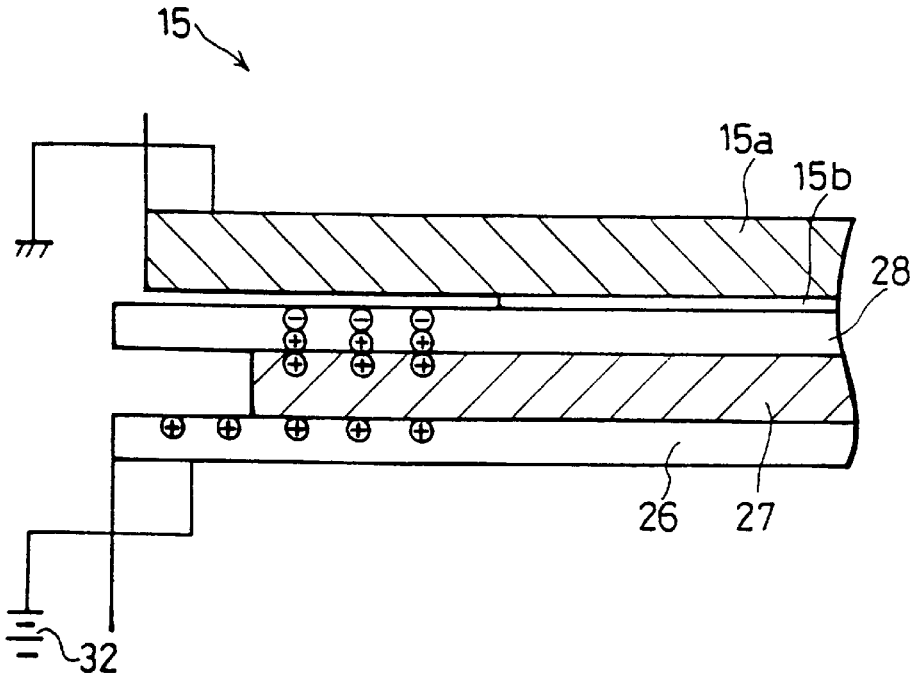
FIG. 8, which shows a charge transfer between the transfer drum and the photoconductor drum, is an explanatory drawing that shows the charge transfer in the case when the widths of the respective layers of the transfer drum is represented by the semiconductive layer<the dielectric layer=the conductive layer.

Therefore, as illustrated in FIG. 8, with respect to these layers in the transfer drum 11, the widths of the conductive layer 26 and the dielectric layer 28 are set at the same size, and the width of the semiconductive layer 27 is set smaller than the above-mentioned widths; thus, it becomes possible to prevent contact between the semiconductive layer 27 and the grounded aluminum base cylinder 15*a*, thereby preventing leakage of charge. Consequently, the transfer drum 11 is allowed to attract toner with a negative charge that has been attracted onto the OPC film 15*b*, and it becomes possible to eliminate miscopying.

Figure 9:
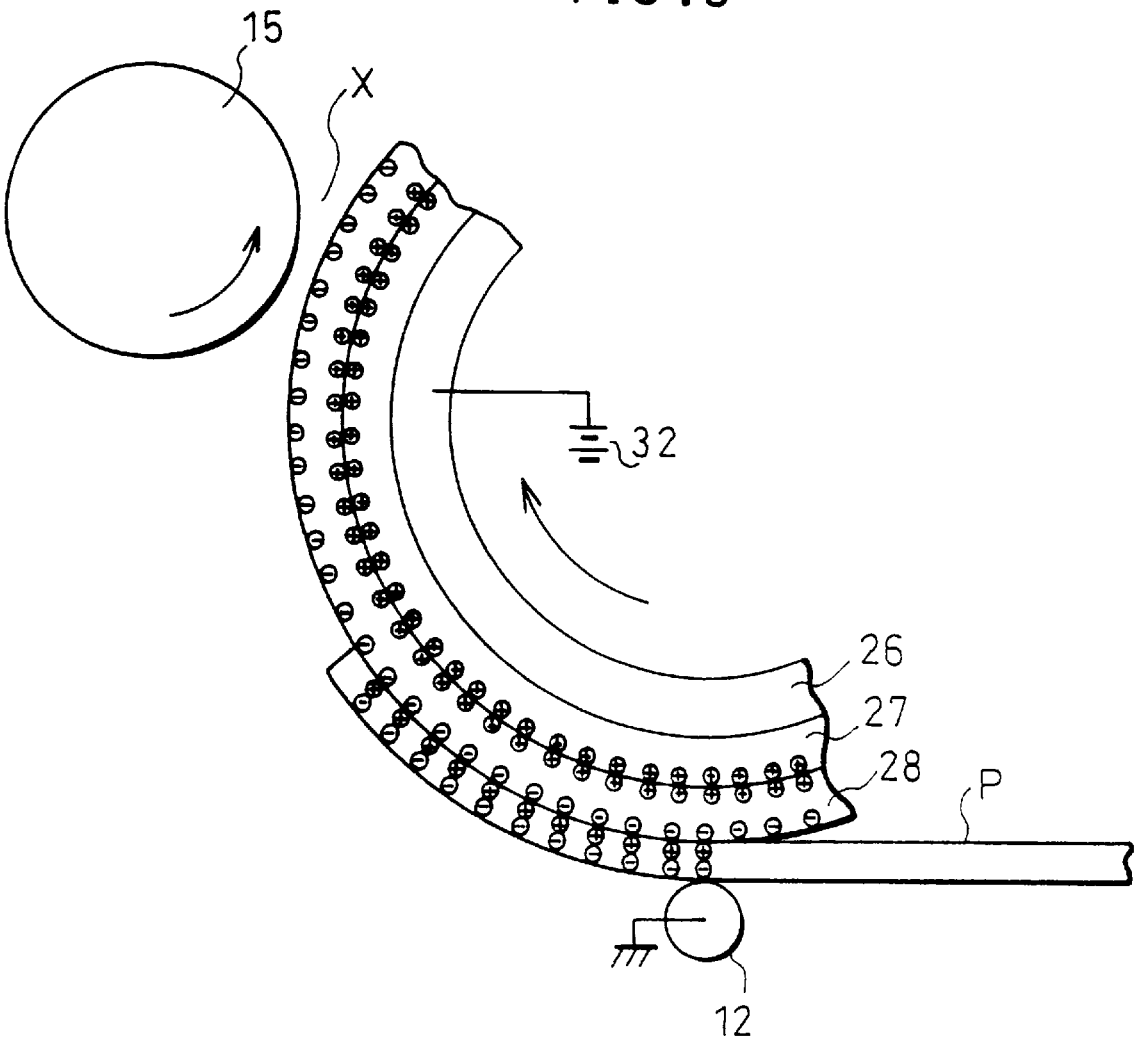
FIG. 9, which shows a charging state of the transfer drum, is an explanatory drawing that shows the initial state in which a copying material has been transported to the transfer drum.
Figure 10:
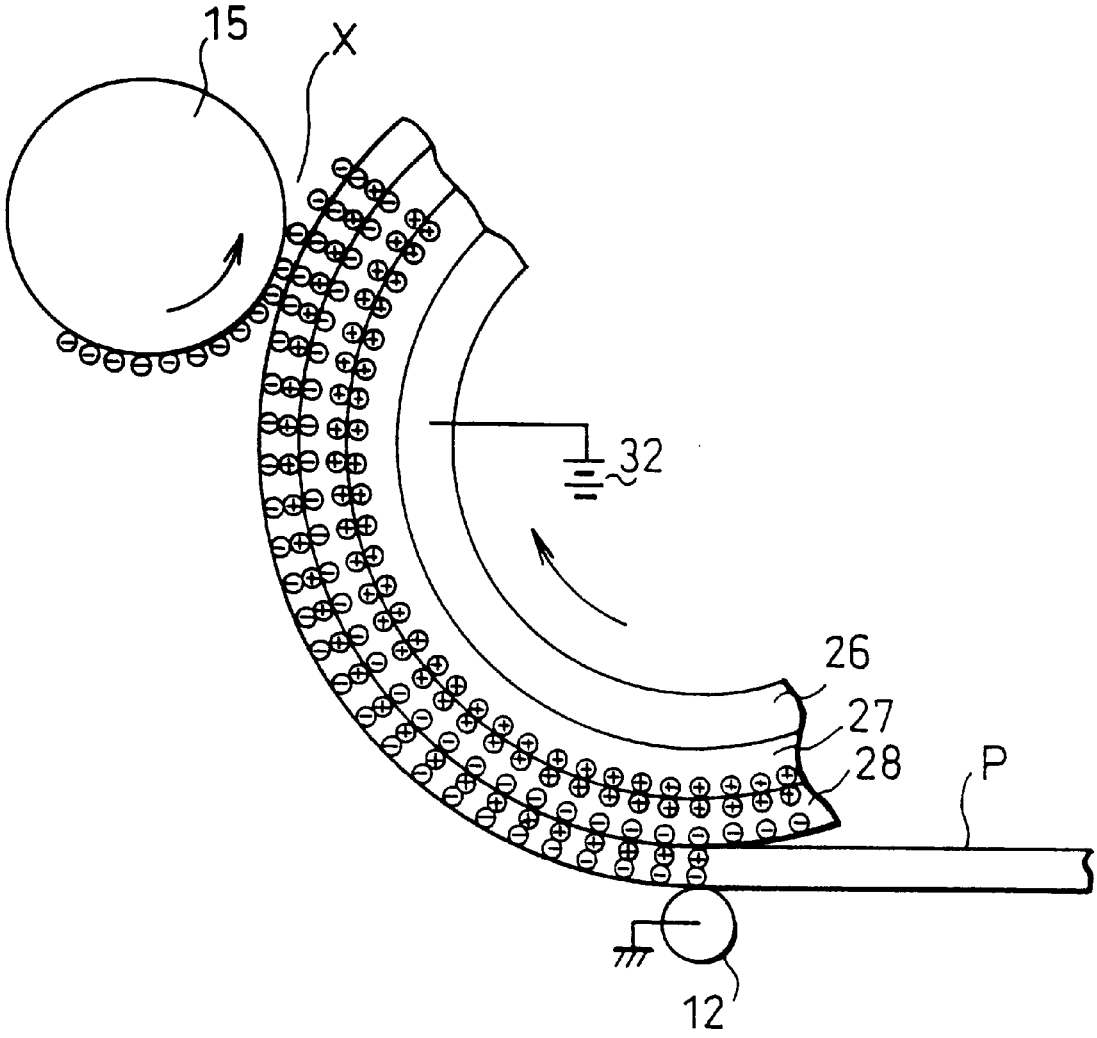
FIG. 10 which shows a charging state of the transfer drum, is an explanatory drawing that shows the state in which the copying material has been transported to the transferring position of the transfer drum.
Figure 11:
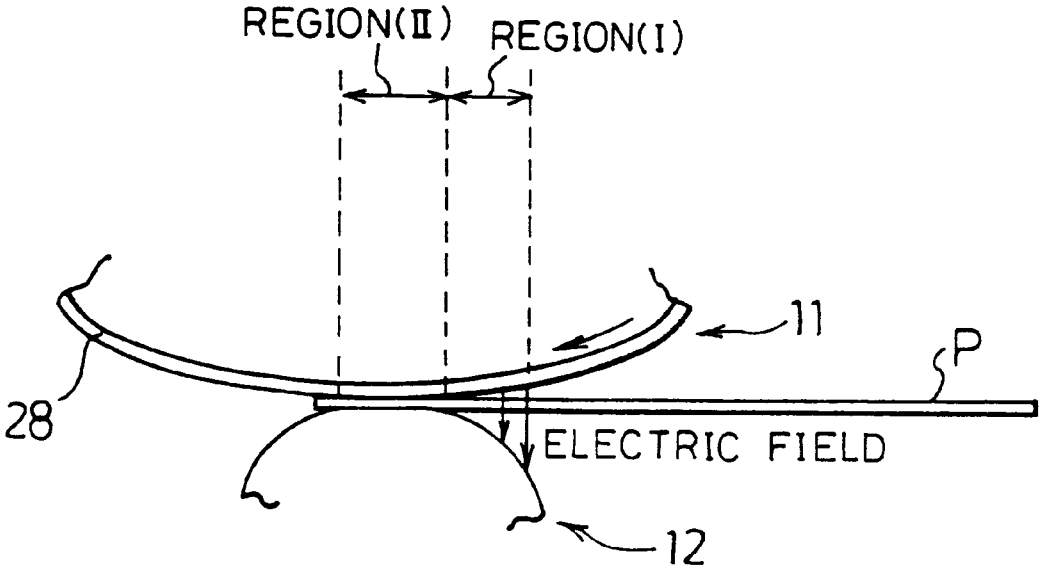
FIG. 11 is an explanatory drawing that shows a Paschen discharge at the nip between the transfer drum and a ground roller.

Referring to FIGS. 9 through 11, the following description will discuss attracting and transferring operations that are carried out by the transfer drum 11 on the copying material P. Here, it is supposed that a positive voltage is applied to the conductive layer 26 from the power supply 32.

First, an explanation will be given of the attracting process of the copying material P. The reason that the copying material P is electrostatically attracted onto the transfer drum 11 is because a charge, which has the reverse polarity to the voltage applied to the conductor layer 26 through the contact charge, is imparted to the copying material P. The mechanism of the contact charge is based upon the Paschen discharge and the charge injection.

In other words, as illustrated in FIG. 9, the copying material P, which has been transported to the transfer drum 11, is pressed onto the surface of the dielectric layer 28 by the ground roller 12 so that, a charge, accumulated in the semiconductive layer 27, is shifted to the dielectric layer 28. Thus, a positive charge is induced on the face at which the dielectric layer 28 is in contact with the semiconductive layer 27.

Then, as illustrated in FIG. 11, the distance between the ground roller 12 and the dielectric layer 28 of the transfer drum 11 becomes shorter, and when the electric-field intensity that is applied to the contact portion of the dielectric layer 28 and the ground roller 12, that is, the nip, increases, an atmospheric electric breakdown occurs, and in region (I), a discharge, that is, a Paschen discharge occurs from the transfer drum 11 side to the ground roller 12 side.

Thus, a negative charge is induced on the surface of the transfer drum 11 (that is, the face at which the dielectric layer 28 contacts the copying material P), and a positive charge is induced inside the copying material P (that is, the contact surface against the dielectric layer 28).

Further, upon completion of the discharge, in the nip between the ground roller 12 and the transfer drum 11, that is, in region (II), a charge injection occurs from the ground roller 12 side to the transfer drum 11 side so that a negative charge is further induced outside the copying material P (that is, the contact surface against the ground roller 12).

In this way, since the charge, accumulated outside the copying material P, exhibits the reverse polarity to the voltage that is applied to the conductive layer 26, an electrostatic attracting force is exerted between the copying material P and the conductive layer 26 so that the copying material P is electrostatically attracted to the transfer drum 11. In other words, it is considered that the higher the charge potential of the copying material P, the greater the electrostatic attracting force to the transfer drum 11.

Further, since the ground roller 12 and the transfer drum 11 rotate, the surface of the transfer drum 11 is uniformly charged. Then, the copying material P, attracted onto the transfer drum 11, is transported to transferring position X for toner images (see FIG. 9) following rotation of the transfer drum 11 in the direction of the arrow, with the outside thereof being negatively charged; thus, a transferring operation for the toner image is carried out.

Next, an explanation will be given of the transferring process of the copying material P. As illustrated in FIG. 10, toner having a negative charge is attracted onto the surface of the photoconductor drum 15. Therefore, when the copying material P whose surface is negatively charged is transported to transferring position X, it might appear that an repulsive force is exerted between the copying material P and the toner on the photoconductive drum 15; however, in fact, an attracting force, which cancels the repulsive force between the copying material P and the toner on the photoconductive drum 15, is exerted by the power supply 32. As a result, the toner image is copied onto the copying material P.

With the attracting and transferring operations of this type, the attracting and transferring of the copying material P is not carried out by conventional charge injection using an atmospheric discharge, but carried out by charge induction; therefore, it is possible to reduce the voltage, and also to control the voltage very easily. Moreover, since this method is hardly susceptible to environment conditions, such as air temperature and moisture, it is possible to eliminate variations in the surface electric potential of the transfer drum 11, and consequently to eliminate disadvantages, such as failure in attracting the copying material P and degradation in print quality. Furthermore, the charging of the transfer drum 11 is carried out by a contact charging operation; therefore, even if the surface of the transfer drum 11 has scratches, the electric-field region is not altered so that the electric field balance is not fluctuated at the scratched portions on the surface of the transfer drum 11. Consequently, it becomes possible to improve the transferring efficiency.

Additionally, the nip width of the transfer drum 11 and the ground roller 12 may be adjusted, for example, by changing the hardness of the semiconductive layer 27 of the transfer drum 11 or changing the contact pressure between the transfer drum 11 and the photoconductor drum 15.

Next, an explanation will be given of the nip (the attracting position) between the transfer drum 11 and the ground roller 12.

In general, it is generally known that depending on different kinds of the copying material P, the time in which a given position on the copying material P passes through the nip width formed between the ground roller 12 and the transfer drum 11, that is, the amount of charge of the copying material P within the nip time, is varied. In other words, the attracting and holding electric field for attracting the copying material P tends to vary depending on the kinds of copying material P.

Figure 12:
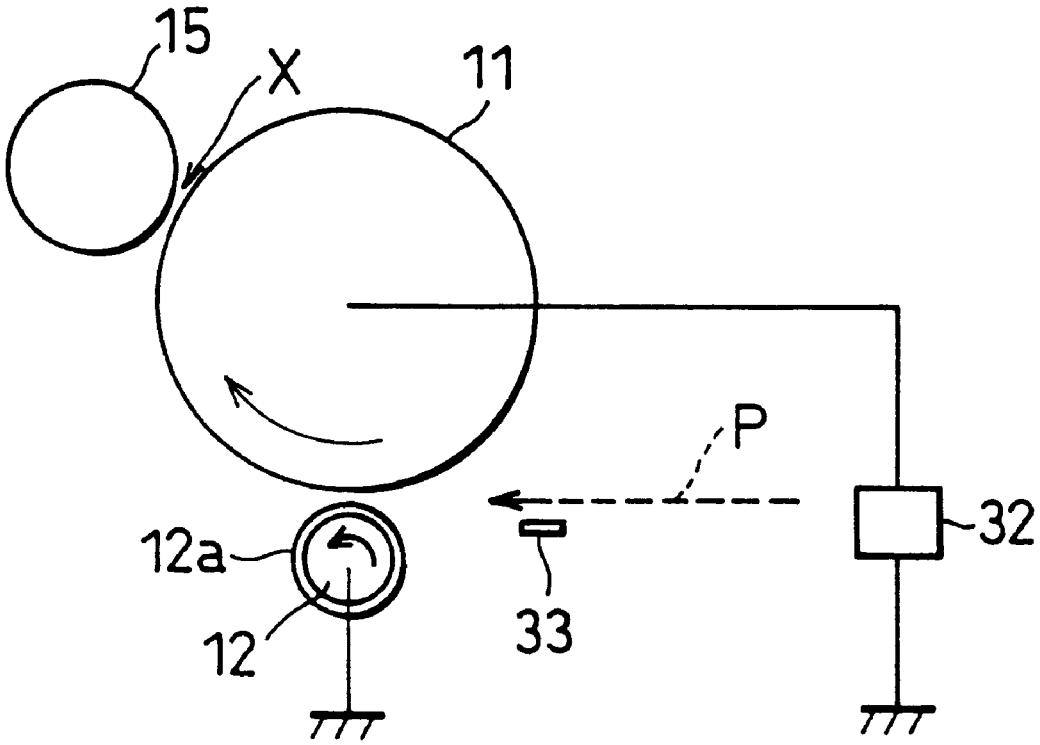
FIG. 12 is a view that shows the construction of a copying-material detection sensor in the image-forming apparatus.

The following description will discuss a method for adjusting the nip time. As illustrated in FIG. 12, the present image-forming apparatus is provided with a copying-material detection sensor 33 for detecting the kind of the copying material P. The copying-material detection sensor 33 is connected to a control means, not shown, and the control mean provides control in such a manner that the physical properties of the copying material P that has been transported to the transfer drum 11 are measured before the copying material P has been electrostatically attracted onto the transfer drum 11; thus, the kind of the copying material P is detected.

In other words, the copying-material detection sensor 33 detects whether a sheet in question is paper or a synthetic resin sheet for use in OHP, for example, by measuring the transmittance, or detects whether a sheet of paper in question is thick paper or thin paper, for example, by detecting the thickness of the sheet of paper. Then, the nip time is adjusted depending on the kind of the copying material P (for example, whether it is paper or a synthetic resin sheet for use in OHP, or whether it is thick paper or thin paper) that has been detected as described above.

The nip time is determined by the following ratio: (the nip width formed between the transfer drum 11 and the ground roller 12)/(the rotation speed of the transfer drum 11). Further, the nip width may also be adjusted, for example, by changing the hardness of the semiconductive layer 27.

Here, the hardness of the semiconductive layer 27 is stipulated by the Asker C standard. The Asker C is a standard set by the Japan Rubber Association, in which a needle with a ball-point for measuring the hardness is pressed onto the surface of a sample by a spring force, and when the resistance of the sample balances the force of the spring, the hardness is indicated by the depth in which the needle indents the sample at that time (indentation depth).

In the Asker C standard, when the indention depth at the time when a load of 55 g is given to the spring is equal to the maximum dislocation of the needle, the hardness of this sample is defined as 0 degree, and when the indention depth at the time when a load of 855 g is given to the spring is 0, the hardness of the sample is defined as 100 degrees. The following Table 1 shows the relationship between the Asker C and the attracting effect of the copying material P.

TABLE 1

| Hardness | 10 | 15 | 20 | 25 | 30 | 40 | 50 | 60 | 70 | 80 | 90 |
|---|---|---|---|---|---|---|---|---|---|---|---|
| Attracting Effect | x | x | Δ | ○ | ○ | ○ | ○ | Δ | Δ | Δ | x |

The hardness is based upon the Asker C Standard of the Japan Rubber Association.

In Table 1, (○) indicates that the attracting effect is so great that the copying material P is electrostatically attracted onto the transfer drum 11 stably during the time in which the transfer drum 11 rotates four times (in which toners of four colors can be transferred.) Further, (Δ) indicates that the attracting effect is insufficient, with the result that although the copying material P is electrostatically attracted onto the transfer drum 11 during the time in which the transfer drum 11 rotates four times, the leading edge or the rear edge of the copying material P exfoliates from the transfer drum 11. Moreover, (×) indicates that no attracting effect is obtained, with the result that the copying material P comes off the transfer drum 11 by the time the transfer drum 11 makes four rotations.

The results of Table 1 show that the hardness of the semiconductive layer 27 should be set in the range of 20 to 80 on the Asker C in order to obtain an attracting effect. In other words, it is preferable to set the hardness of the semiconductive layer 27 in the range of 20 to 80 on the Asker C since the copying material P is electrostatically attracted onto the transfer drum 11 during the four rotations of the transfer drum 11. Moreover, it is most preferable to set the hardness of the semiconductive layer 27 in the range of 25 to 50 on the Asker C since the copying material P is electrostatically attracted onto the transfer drum 11 more stably during the four rotations of the transfer drum 11.

In the case when the hardness of the semiconductive layer 27 is smaller than 20 on the Asker C, the hardness becomes too low, resulting in curls in the copying material P having opposite directions (which do not conform to the transfer drum 11.) Consequently, it is not preferable to apply this case since the copying material P is not electrostatically attracted onto the transfer drum 11 in a stable manner.

On the other hand, in the case when the hardness of the semiconductive layer 27 is greater than 80 on the Asker C, the hardness becomes too high, resulting in a small nip width between the transfer drum 11 and the ground roller 12. Consequently it is not preferable to apply this case since the copying material P is not electrostatically attracted onto the transfer drum 11 in a stable manner. Moreover, when the hardness of the semiconductive layer 27 is greater than 80 on the Asker C, the hardness is too high, resulting in an excessive contact pressure between the photoconductor drum 15 and the transfer drum 11 and the subsequent degradation in the durability of the photoconductor.

Figure 13:
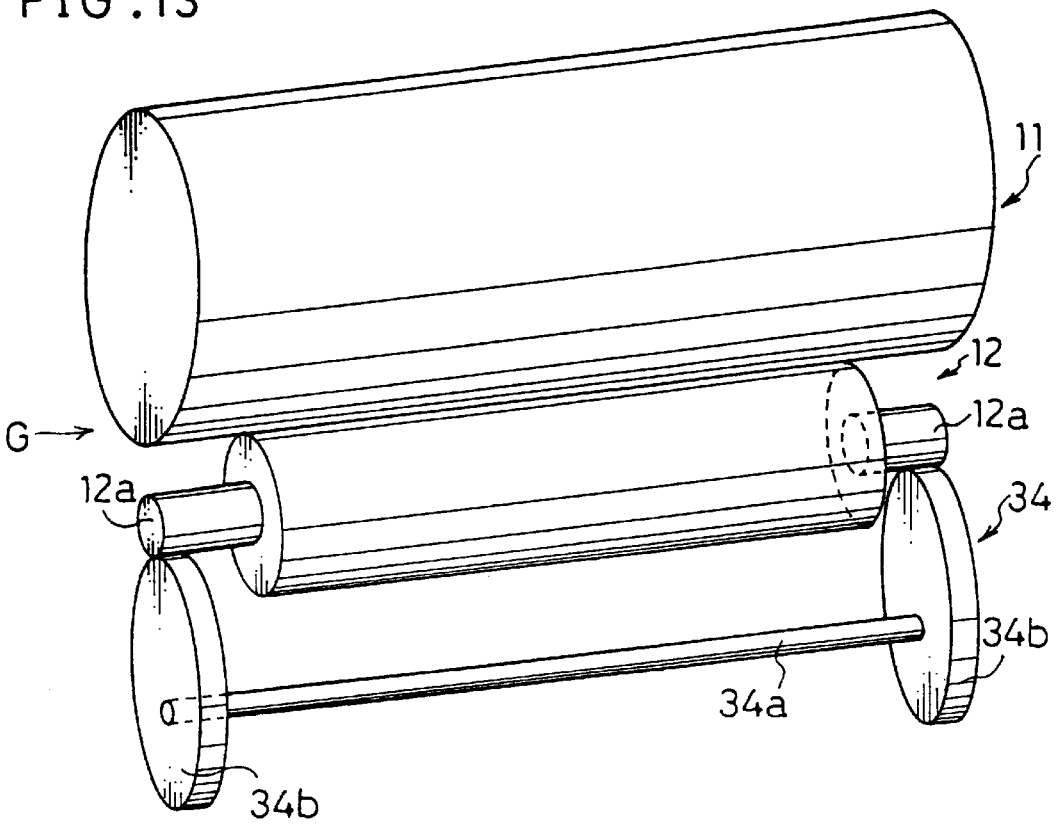
FIG. 13 is a perspective view that shows an arrangement for changing the contact pressure between the transfer drum and the ground roller.

The nip width can also be adjusted by changing the contact pressure between the transfer drum 11 and the ground roller 12. This contact pressure between the transfer drum 11 and the ground roller 12 can be changed by, for example, installing an eccentric cam 34 for pressing the ground roller 12 below the ground roller 12 as shown in FIG. 13 and adjusting the pressing force of the eccentric cam 34 against the ground roller 12.

The eccentric cam 34 is constituted by a shaft (an axis) 34*a* and pressing members 34*b* each of which is made of a flat plate having the same elliptical shape, and attached to each end of the shaft 34*a*. The eccentric cam 34 is arranged so that the pressing members 34*b* contact the rotary axis 12*a* of the ground roller 12 that extends in the length direction of the grand roller 12 from the centers of both sides in the length direction. Here, the shaft 34*a* supports each pressing member 34*b* at the position that is not co-axial with the pressing member 34*b*, and is placed parallel to the ground roller 12.

Figure 14:
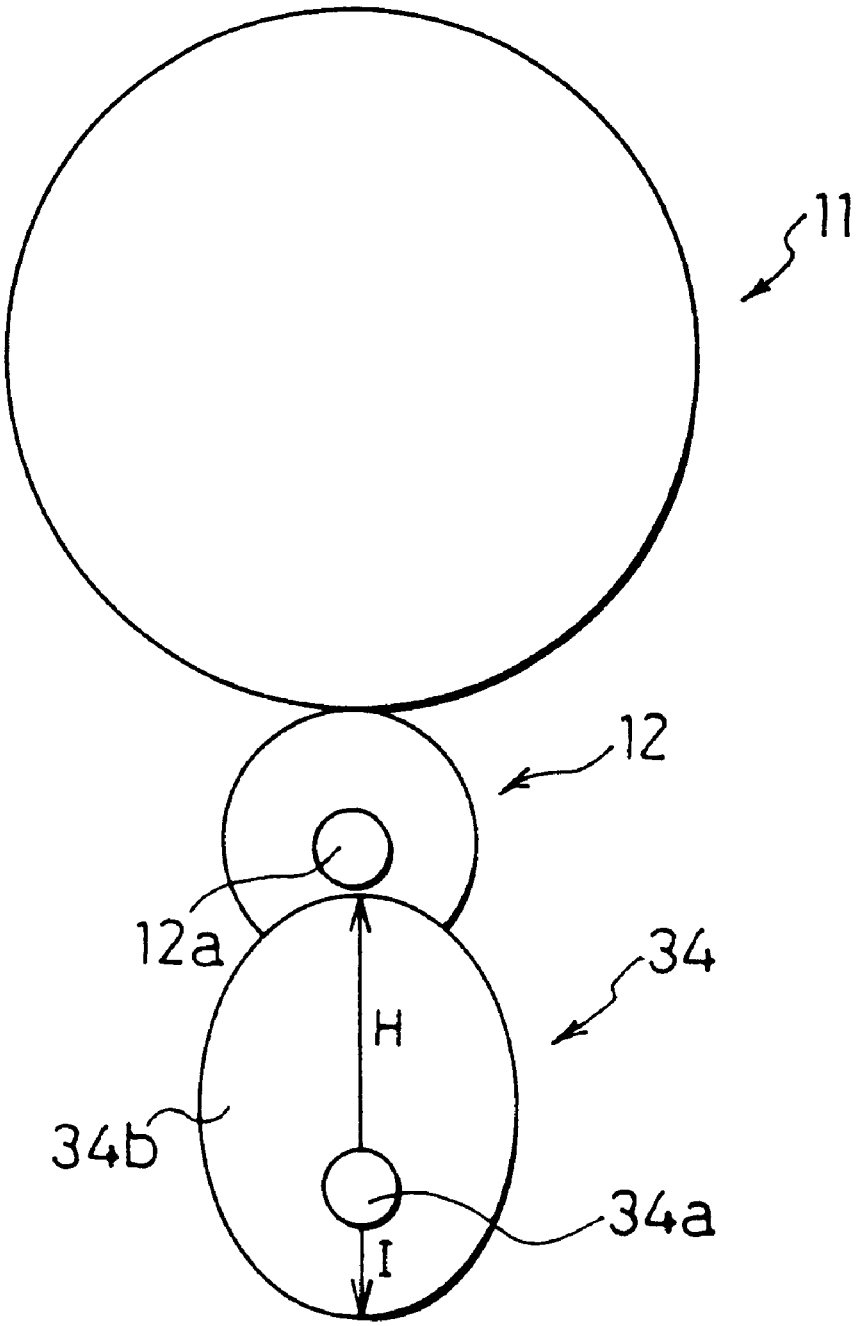
FIG. 14 is a side view of FIG. 13 when viewed from G side.

As illustrated in FIG. 14 in which the transfer drum 11, the ground roller 12 and the eccentric cam 34 are viewed sideways (from G side of FIG. 13), the contact pressure between the transfer drum 11 and the ground roller 12 becomes greatest when the distance between the shaft 34*a* and the rotary axis 12*a* becomes farthest (in which the distance from the shaft 34*a* to the circumferential edge of each pressing member 34*b* is represented by H in the Figure), and it becomes smallest when the distance between the shaft 34*a* and the rotary shaft 12*a* becomes closest (in which the distance from the shaft 34*a* to the circumferential edge of each pressing member 34*b* is represented by I in the Figure).

With this arrangement, the pressing force of the eccentric cam 34 against the ground roller 12 is adjusted by rotating the eccentric cam 34 so that the contact pressure between the transfer drum 11 and the ground roller 12 is adjusted. Here, the pressing member 34*b* is not particularly limited to a specific shape as long as its contact portion against the rotary axis 12*a*, that is, its circumferential edge, is shaped into a curve, and a round plate or a ball may be used. The following Table 2 shows the relationship between the nip width and the attracting effect of the copying material P. Here, (○, Δ and ×) are used in the same way as Table 1.

TABLE 2

| Nip Width (mm) | 0.0 | 0.5 | 1.0 | 2.0 | 3.0 | 4.0 | 5.0 | 6.0 | 7.0 |
|---|---|---|---|---|---|---|---|---|---|
| Attracting Eftect | x | Δ | ○ | ○ | ○ | ○ | Δ | x | x |

The results in Table 2 show that it is possible to electrostatically attract the copying material P onto the transfer drum 11 during four rotations of the drum 11 by setting the nip width in the range of 0.5 mm to 5.0 mm. In other words, the nip width is preferably set in the range of 0.5 mm to 5.0 mm in terms of dynamic strength (mechanical strength), and it is most preferably set in the range of 1.0 mm to 4.0 mm in terms of dynamic strength (mechanical strength).

Additionally, in the case of the nip width smaller than 0.5 mm, the ground roller 12 is not driven by the transfer drum 11, failing to attract and transport the copying material P stably during the four rotations of the transfer drum 11; therefore, this case is not preferable. In contrast, in the case of the nip width greater than 5.0 mm, the nip pressure becomes too strong, resulting in curls in the copying material P having opposite directions (which do not conform to the transfer drum 11.) Consequently, it is not preferable to apply this case since the copying material P is not electrostatically attracted onto the transfer drum 11 in a stable manner.

As described above, when the rotation speed of the transfer drum 11 is constant, the nip time is easily altered by changing the hardness of the semiconductive layer 27 and/or the contact pressure between the transfer drum 11 and the ground roller 12. Further, the nip time may also be adjusted by setting the nip width constant and variably changing the rotation speed of the transfer drum 11. However, when the nip time is altered by changing the rotation speed of the transfer drum 11, it is necessary to slow the rotation speed of the transfer drum 11 in order to increase the nip time. When the rotation speed of the transfer drum 11 is set slow in this way, the transfer efficiency per minute is reduced. Consequently, it is more preferable to change the nip time by adjusting the hardness of the semiconductive layer 27 and/or the contact pressure between the transfer drum 11 and the ground roller 12.

Next, referring to FIGS. 15 through 18, the following description will explain the relationship between the kind of copying material P and the amount of electrostatic charge of the copying material P that is imparted within the nip time.

Figure 15:
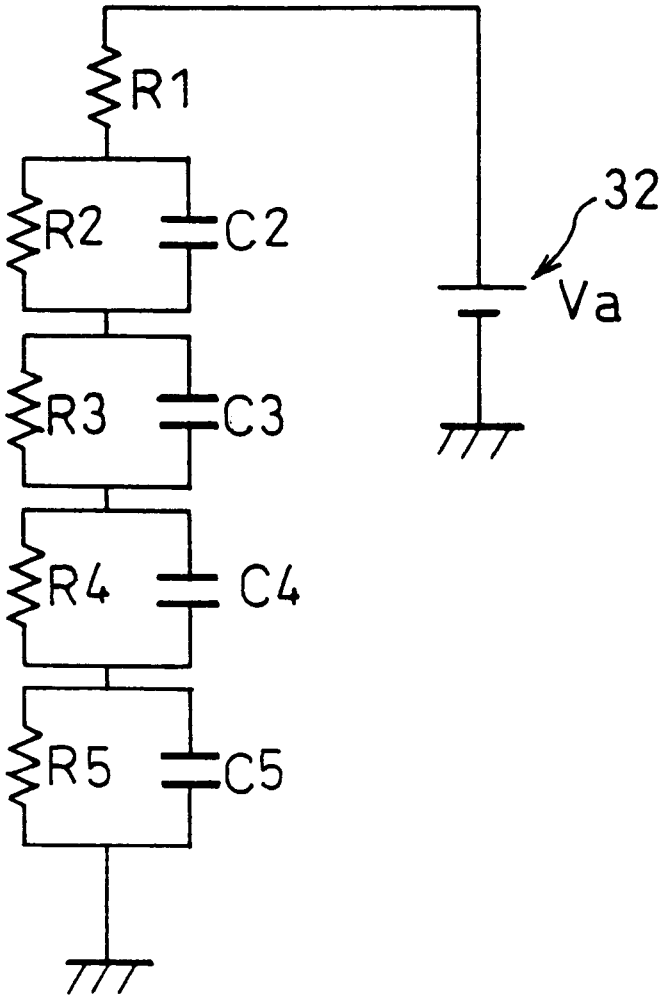
FIG. 15 is a circuit diagram that shows an equivalent circuit to a charge-injecting mechanism between the transfer drum and the ground roller.

FIG. 15 shows an equivalent circuit indicating the charge-injecting mechanism after the aforementioned Paschen discharge. Va represents a voltage that is applied to the conductive layer 26 from the power supply 32, R1 represents a resistance of the semiconductive layer 27, R2 represents a contact resistance between the semiconductive layer 27 and the dielectric layer 28, R3 represents a resistance of the dielectric layer 28, R4 represents a resistance of the copying material P, and R5 represents a contact resistance between the copying material P and the ground roller 12. Further, C2 represents a capacitance between the semiconductive layer 27 and the dielectric layer 28, C3 represents a capacitance of the dielectric layer 28, C4 represents a capacitance of the copying material P, and CS represents a capacitance between the ground roller 12 and the copying material P.

In order to find the amount of charge (electric potential) accumulated in the copying material P, the above-mentioned equivalent circuit is analyzed with respect to the electric potential difference that is imposed on C5, supposing that the amount of electrostatic charge exerted by the Paschen discharge is the initial electric potential.

Then, the analytic equation of the final charged electric potential V1 of the copying material P, which is found so as to make the total charged electric potential of both the Paschen discharge and the charge injection form the charged electric potential of the copying material P, is given as follows:

$$V1=A\times(b'\times e^{Bt}-c'\times e^{Ct}).$$

In the above equation, A, B, C, b' and c' are constants that are dependent on the above-mentioned circuit (dependent on the resistances, capacitances, etc. of the respective layers). Therefore, the final charged electric potential V1 can be represented by the sum of exponential functions that vary with the elapsed time t.

Figure 16:
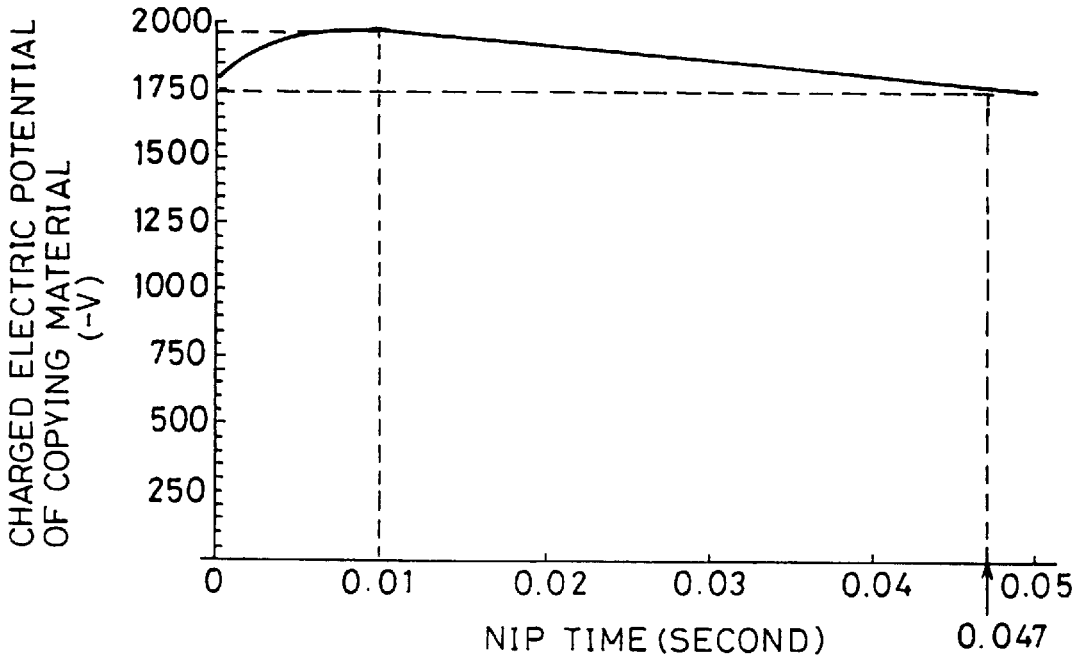
FIG. 16 is a graph that shows the relationship between the amount of charge and the nip time in the copying material.

Supposing that the resistance of the semiconductive layer 27 (the volume resistivity) is $10^7\Omega\cdot$cm, the resistance (the volume resistivity) of the dielectric layer 28 is $10^9\Omega\cdot$cm, the applied voltage is 3.0 kV, and the copying material P is paper, the following graph shows the relationship between the nip time and the charged electric potential (the amount of electrostatic charge) of the copying material P that has been found based on the above-mentioned analytic equation using the amount of charge injection within the nip time: As a result, as shown in FIG. 16, it is found that the amount of electrostatic charge in the copying material P has a maximum value as the nip time varies.

Here, supposing that the rotation speed of the transfer drum 11 is 85 mm/second and the nip width formed between the transfer drum 11 and the ground roller 12 is 4 mm, the nip time becomes 0.047 second. Based on the results shown in FIG. 16, the amount of an electrostatic charge (−1740 V) of the copying material P in the nip time of 0.047 second is smaller than the amount of the initial electrostatic charge (−1800 V); this shows that the electrostatic attracting force of the copying material P becomes weaker.

In this case, in order to set the amount of electrostatic charge so that it does not at least become lower than the amount of the initial electrostatic charge after the charge injection, it is proposed that the nip time be adjusted by setting the nip width smaller (for example, at 3 mm) or increasing the rotation speed of the transfer drum 11 (for example, to 95 mm/second.) Further, for more effective charge injection, it is proposed that the nip width be set at 0.85 mm or that the rotation speed of the transfer drum 11 be set at 300 mm/second so as to carry out the charge injection at the time when the amount of electrostatic charge of the copying material P is at the maximum value (the nip time: 0.01 second).

In this way, based upon the relationship between the nip time and the amount of charge injection within the nip time, the optimal nip width is calculated from the electrostatical point of view, and an optimal nip width is defined by taking into consideration both the electrostatically optimal nip width and the optimal nip width from the viewpoint of mechanical strength; thus, the nip time can be set so as to carry out the charge injection more effectively.

As described above, in the case when the amount of electrostatic charge of the copying material P has a maximum value as the nip time varies, it becomes possible to electrostatically attract the copying material P onto the dielectric layer 28 of the transfer drum 11 in a stable manner by setting the nip time so that the amount of electrostatic charge of the copying material P does not become lower than the initial electrostatic charge. Moreover, by setting the above-mentioned maximum value as the nip passage time, it becomes possible to carry out the charge injection more efficiently and consequently to charge the copying material P more effectively. Thus, the copying material P can be electrostatically attracted onto the dielectric layer 28 more stably. Consequently, it becomes possible to transfer toner from the photoconductor drum 15 to the copying material P desirably without the drawback that the copying material P comes off the transfer drum 11 before all the toner images with respective colors, formed on the photoconductor drum 15, have been transferred onto the copying material P. Therefore, it is possible to always provide stable images.

Moreover, under the same conditions, that is, the resistance of the semiconductive layer 27 (the volume resistivity): $10^7\Omega\cdot$cm, the resistance (the volume resistivity) of the dielectric layer 28: $10^9\Omega\cdot$cm and the applied voltage: 3.0 kV, except that the copying material P is changed from paper to a synthetic resin sheet for use in OHP, the relationship between the nip time and the amount of charge injection within the nip time was found based on the aforementioned analytic equation; and the results are shown in a graph in FIG. 17.

As a result, it is found that in the case when a synthetic resin sheet for use in OHP is used as the copying material P, the amount of electrostatic charge of the copying material P tends to increase as the nip time becomes longer. In other words, if the set nip time satisfies the mechanical nip conditions, for example, shown in Table 1 or Table 2 (that is, the setting in which the hardness of the semiconductive layer 27 is set in the range of 20 to 80 on the Asker C or the setting in which the nip width between the transfer drum 11 and the ground roller 12 is set in the range of 0.5 mm to 5.0 mm), the charge injection is always carried out. The following Table 3 shows the relationship between the charged electric potential difference of the copying material P after the charge injection as compared with that before the charge injection and the attracting effect and printing efficiency of the copying material P. In Table 3, (○) indicates that a desired attracting effect as well as a desired printing efficiency are provided, and (×) indicates that no attracting effect or no printing efficiency is available.

TABLE 3

| Potential Difference before and after Charge Injection | 0 | 200 | 400 | 600 | 800 | 1000 | 1200 | 1400 | 1600 or more |
|---|---|---|---|---|---|---|---|---|---|
| Attracting Effect and Printing Efficiency | ○ | ○ | ○ | ○ | ○ | ○ | x | x | x |

Based upon the results shown in Table 3, it is found that when an electric potential difference exceeding 1000 V is provided before and after the charge injection, the attracting force to the copying material P becomes weaker with the result that the copying material P comes off the transfer drum 11 by the time when the transfer drum 11 has rotated four times. This is supposedly due to mechanical reasons in which, for example, when the nip time is increased by increasing, for example, the nip width in order to increase the amount of applying charge, the nip pressure between the transfer drum 11 and the ground roller 12 becomes greater, resulting in curls in the copying material P in opposite directions to the transfer drum 11 (which do not conform to the transfer drum 11.) Further, in order to increase the amount of charge application, the processing speed may be slowed down with the nip width unchanged, that is, the rotation speed of the transfer drum 11 may be slowed down, so as to increase the nip time. In this case, the processing speed, which can apply an amount of charge that is great enough to exert an electric potential difference exceeding 1000 V, is so slow that the printing efficiency per minute is reduced. Consequently, the electric potential difference before and after the charge injection is most preferably set in the range of 0 V±1000 V.

Therefore, when the amount of electrostatic charge of the copying material P increases as the nip time becomes longer as described above, it becomes possible to electrostatically attract the copying material P onto the dielectric layer 28 in a stable manner by setting the nip time so that the difference between the charged electric potential of the copying material P before the charge injection and the charged electric potential thereof after the charge injection falls in the range of 0 V±1000 V. Thus, it becomes possible to transfer toner from the photoconductor drum 15 to the copying material P desirably without the drawback that the copying material P comes off the transfer drum 11 before all the toner images with respective colors, formed on the photoconductor drum 15, have been transferred onto the copying material P. Therefore, it is possible to always provide stable images.

Moreover, under the conditions that the resistance of the semiconductive layer 27 (the volume resistivity) and the resistance (the volume resistivity) of the dielectric layer 28 are set higher (that is, the resistance of the semiconductive layer 27 (the volume resistivity): $10^9\Omega\cdot$cm and the resistance (the volume resistivity) of the dielectric layer 28: $10^{10}\Omega\cdot$cm) with an applied voltage of 3.0 kV, and using paper as the copying material P, the relationship between the nip time and the amount of charge injection within the nip time was found based on the aforementioned analytic equation; and the results are shown in a graph in FIG. 18.

As a result, in the case when paper is used as the copying material P, if the resistances of the semiconductive layer 27 and the conductive layer 28 are high, no charge injection is carried out after passage through the nip width, and the amount of electrostatic charge of the copying material P tends to decrease as compared with the amount of the initial electrostatic charge, while the nip time becomes longer. The following Table 4 shows the relationship between the rate of the charged electric potential after the charge injection to that before the charge injection and the attracting effect of the copying material P. Here, in the same manner as Table 1, (○ and ×) indicate desired attracting efficiency and undesired attracting efficiency respectively.

TABLE 4

| Rate of Charged Potentials before and after Charge Injection | 10 or less | 20 | 30 | 40 | 50 | 60 | 70 | 80 | 90 or more |
|---|---|---|---|---|---|---|---|---|---|
| Attracting Effect | x | x | x | x | ○ | ○ | ○ | ○ | ○ |

From the results shown in Table 4, it is found that if the rate of the charged electric potential (the amount of electrostatic charge) after the charge injection to that before the charge injection is not less than 50%, the copying material P can be stably attracted onto the transfer drum 11 during the time in which the transfer drum 11 rotates four times.

This indicates that, in the case when the amount of electrostatic charge of the copying material P tends to decrease as compared with the amount of the initial electrostatic charge while the nip time becomes longer, the nip time is preferably set so that the nip time satisfies the mechanical nip condition, for example, as described in Table 1 or Table 2 (that is, the hardness of the semiconductive layer 27 as set in the range of 20 to 80 on the Asker C or the nip width between the transfer drum 11 and the ground roller 12 as set in the range of 0.5 mm to 5.0 mm) and so that the amount of electrostatic charge of the copying material P becomes not less than 50% of the amount of the initial electrostatic charge; thus, it becomes possible to electrostatically attract the copying material P onto the transfer drum 11 in a stable manner. In this case, in order to satisfy the above-mentioned mechanical nip condition and also to make the amount of electrostatic charge of the copying material P not less than 50% of the amount of the initial electrostatic charge, it is proposed that the nip time be set at 0.01 second, for example, by setting the nip width at 0.85 mm or setting the rotation speed of the transfer drum 11 at 300 mm/second.

Therefore, as described above, in the case when the amount of electrostatic charge of the copying material P tends to decrease as compared with the amount of the initial electrostatic charge while the nip time becomes longer, by setting the nip time so that the amount of electrostatic charge of the copying material P becomes not less than 50% of the amount of the initial electrostatic charge, it becomes possible to electrostatically attract the copying material P onto the dielectric layer 28 in a stable manner. Consequently, it becomes possible to transfer toner from the photoconductor drum 15 to the copying material P desirably without the drawback that the copying material P comes off the transfer drum 11 before all the toner images with respective colors, formed on the photoconductor drum 15, have been transferred onto the copying material P. Therefore, it is possible to always provide stable images.

Figure 17:
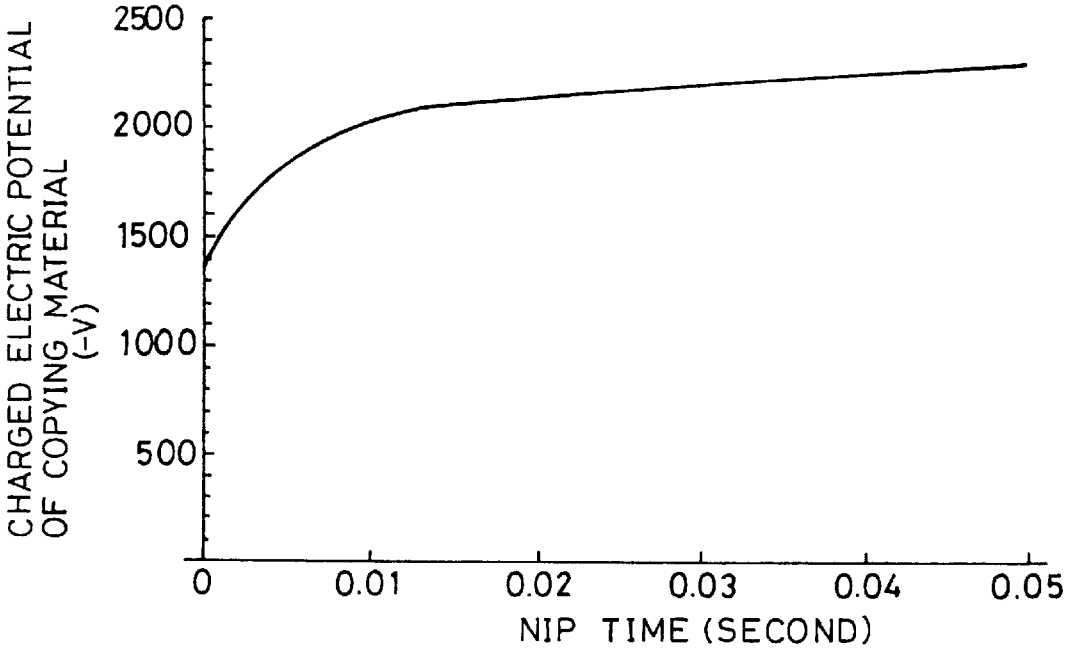
FIG. 17 is a graph that shows the relationship between the amount of charge and the nip time in the copying material under conditions different from those of FIG. 16.
Figure 18:
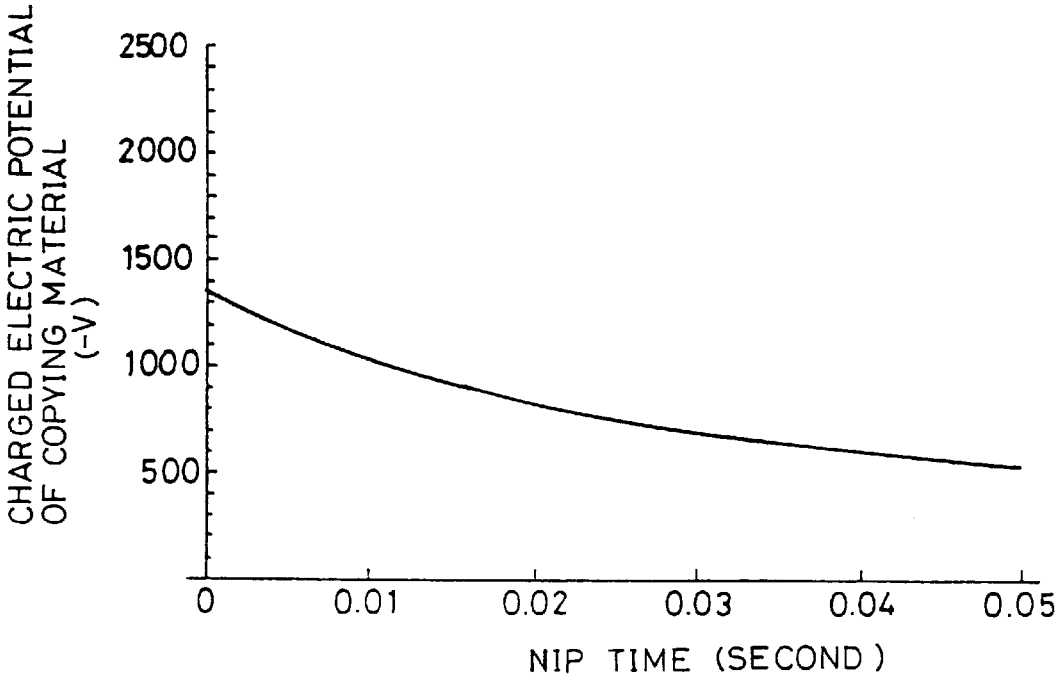
FIG. 18 is a graph that shows the relationship between the amount of charge and the nip time in the copying material under conditions further different from those of FIG. 16.

Furthermore, experiments were carried out by changing the kind of copying material P, the physical property value (the volume resistivity) of the semiconductive layer 27, the physical property value (the volume resistivity) of the dielectric layer 28 and the applied voltage in various ways, and it is confirmed that the tendency of the graph indicating the relationship between the nip time and the charged electric potential of the copying material P corresponds to any of the graphs shown in FIGS. 16 through 18.

Consequently, the relationship between the nip time and the amount of electrostatic charge of the copying material P is mainly classified into three kinds of pattern (that is, one pattern in which the amount of electrostatic charge of the copying material P has a maximum value as the nip time varies, another pattern in which the amount of electrostatic charge of the copying material P increases as the nip time becomes longer, and the other pattern in which the amount of electrostatic charge of the copying material P decreases as the nip time becomes longer.)

Therefore, it is proposed that, with respect to each case in which a given semiconductive layer 27, dielectric layer 28, etc. are used, the relationship between the amount of electrostatic charge of the copying material P and the nip time be preliminarily found for each of the kinds of copying material P; this makes it possible to easily judge how much nip time is required for electrostatically attracting the copying material P onto the dielectric layer 28 in a stable manner depending on the kinds of copying material P to be used, even if the physical property (the resistivity) of the semiconductive layer 27, the physical property (the resistivity) of the dielectric layer 28, the applied voltage, or the kind of copying material P are changed.

Moreover, when the relationship between the nip time and the amount of electrostatic charge of the copying material P is preliminarily found for each of the kinds of copying material P, the nip time can be changed to an optimal nip time that is required for effectively giving the amount of charge so as to stably attract the copying material P onto the dielectric layer 28 depending on the kinds of copying material P to be used. Furthermore, by changing the nip time based upon the relationship between the amount of electrostatic charge of the copying material P to be used in this manner, it becomes possible to electrostatically attract the copying material P onto the dielectric layer 28 in a stable manner.

By changing the nip time depending on the kinds of copying material P that have been detected by the copying-material detection sensor 33, the charge injection can be carried out effectively. Thus, it becomes possible to electrostatically attract the copying material P onto the transfer drum 11 in a stable manner.

Additionally, the means for detecting the kind of copying material P is not specifically limited; and the means for judging the kind of copying material P is not specifically limited. With respect to the judgement of the kind of copying material P, the user may visually make a judgement and carry out the corresponding operation for changing the nip means based on the result; however, the nip time can be changed automatically so that the copying material P is electrostatically attracted onto the transfer drum 11 in a stable manner by detecting the kinds of copying material P using a means (for example, the copying-material detection sensor 33) for detecting the kind of copying material P and changing the contact pressure between the transfer drum 11 and the ground roller 12 through control of, for example, the eccentric cam 34, based upon the relationship between the nip time and the amount of electrostatic charge of the copying material P that has been preliminarily stored.

Next, an explanation will be given of the transfer drum 11 and the nip (the transferring position, the contact section, etc.) of the photoconductor drum 15.

As described earlier, difference in the kind of copying material P differs the time during which a given position of the copying material P passes through the nip width formed between the ground roller 12 and the transfer drum 11, that is, the amount of electrostatic charge of the copying material P within the nip time. Therefore, when a transferring operation is carried out at the nip between the photoconductor drum 15 and the transfer drum 11, the transferring electric field sometimes changes depending on the difference in the kind of copying material P.

In particular, when an OHP sheet, a coated sheet, etc. with a high resistance is used as the copying material P. the surface electric potential of the copying material P is altered by repeated contacts between the copying material P and the photoconductor drum 15, resulting in an offset in the effective transferring electric potential difference from the correct value.

For this reason, in the image-forming apparatus of the present embodiment, the transfer section 2 is designed to satisfy the following inequality:

$$\tau > L1/Vp.$$

Figure 1:
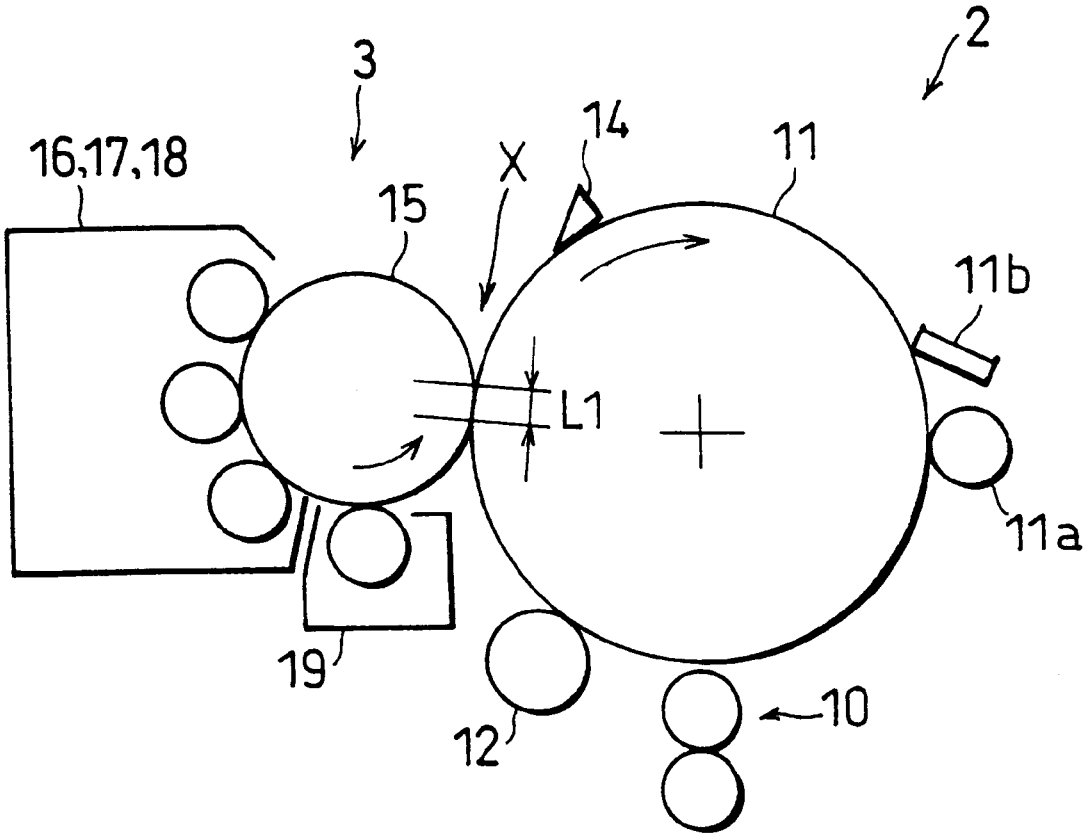
FIG. 1 is an explanatory drawing that shows a nip width between a transfer drum and a photoconductor drum in an image-forming apparatus in accordance with the first embodiment of the present invention.

Here, as shown in FIG. 1, L1 represents the nip width formed by the contact between the transfer drum 11 and the photoconductor drum 15, Vp represents the rotation speed (surface speed) of the transfer drum 11 and the photoconductor drum 15, and $\tau$ represent the time constant of the transfer drum 11.

The time constant $\tau$ is represented by:

$$\tau = CR = \epsilon\epsilon_0\rho.$$

Here, R represents the resistance of the transfer drum 11, C represents the capacitance of the transfer drum 11, and $\epsilon$ represents the dielectric constant of the transfer drum 11, $\epsilon_0$ represents the dielectric constant of vacuum, and $\rho$ represents the volume resistivity of the transfer drum 11.

The time constant $\tau$ is obtained as follows: The resistance R of the transfer drum 11 is calculated by finding the volume resistivity $\rho$ of the transfer drum 11 using the volume-resistivity measuring method as described in J1S·KG6911 or other methods, and the capacitance C of the transfer drum 11 is further found. Moreover, the effective time constant $\tau$ can be measured as follows: An aluminum cylinder, which is the same as one used as the photoconductor drum 15, is pressed onto the transfer drum 11 at the same setting position under the same pressure as the service conditions, and rotated with a voltage applied thereto, and then it is stopped and the surface electric potential of the transfer drum 11 is measured.

As described above, since the transfer section 2 is designed so that it satisfies the above-mentioned conditions, that is, so that the time (L1/Vp) required for the surface of the transfer drum 11 (the circumferential surface) to move the nip width L1 is set smaller than the time constant $\tau$, the transfer drum 11 can be treated as a dielectric within the nip width L1. Therefore, the transferring electric field, exerted between the transfer drum 11 and the photoconductor drum 15, does not vary within the nip width L1; and at least within the nip width L1, it is possible to obtain a stable transferring electric field. In particular, when $\tau>10\times(L1/Vp)$ is satisfied, it has been proved through calculations that the transfer drum 11 can be completely treated as an insulator within the nip width L1; thus, it is possible to obtain a further stable transferring electric field.

Here, supposing that the rotation speed Vp is 85 mm/second and the nip width L1 is approximately 3 mm, the time (L1/Vp) is 0.035 second. Further, the thickness of a PVDF sheet that forms the dielectric layer 28 of the transfer drum 11 was changed to 25 $\mu$m, 50 $\mu$m, 100 $\mu$m and 250 $\mu$m, and the transferring performance was evaluated for each case with the dielectric constant $\epsilon$ being in the range of 7.0 to 14.0 and the volume resistivity $\rho$ being in the range of $1\times10^9$ to $1\times10^{15}$ $\Omega\cdot$cm; and in each case, a desired transferring performance of not less than 80% was obtained by adjusting the applied voltage.

Additionally, in the same manner as the nip width between the transfer drum 11 and the ground roller 12, the above-mentioned nip width L1 can be adjusted, for example, by changing the hardness of the semiconductive layer 27 of the transfer drum 11. Further, the nip width L1 can also be adjusted by changing the contact pressure between the transfer drum 11 and the photoconductor drum 15.

As described above, since the image-forming apparatus of the present embodiment has the transfer section 2 that satisfies the relationship, $\tau>L1/Vp$, the transfer drum 11 can be treated as a dielectric so that a stable transferring electric field can be obtained. Thus, it is possible to carry out a desired toner transferring process even if different kinds of copying material P are used. Further, even if a transfer drum 11 made of inexpensive materials is used, a desired transferring process can be carried out as long as the above-mentioned relationship is satisfied; thus, it is possible to achieve a low cost image-forming apparatus.

Moreover, as described earlier, the transfer drum 11 has a multi-layer structure in which the dielectric layer 28 is stacked on the conductive layer 26 that serves as a conductive base with the semiconductive layer 27 made of foamed urethane interpolated in between; therefore, since a cushion property is imparted by the semiconductive layer 27, degradation in the dielectric layer 28 is suppressed, and the running cost can be reduced. Further, with the elasticity of the semiconductive layer 27, the nip width can be adjusted easily so that it becomes possible to easily obtain a desired nip width having an optimal transferring performance.

Moreover, the semiconductive layer 27 is constituted by a foamed material so that void is provided between the semiconductive layer 27 and the dielectric layer 28, and a discharge phenomenon appearing in the void is utilized to raise a charge on the back surface (the surface facing the semiconductive layer 27) of the dielectric layer 28, so as to exert a strong attracting force to the copying material P; this also makes it possible to provide a better attracting property, and also to positively prevent degradation in images due to an undesired attracting process.

Additionally, since the void is pushed to disappear or at least to become small at transferring position X due to pressure by the photoconductor drum 15, it is possible to avoid degradation in image quality, which might occur because of a disturbance in the transferring electric field due to the discharge phenomenon in the void. In other words, the void can be utilized for maintaining an attracting electric field at positions with no semiconductive layer 27 contacting the dielectric layer 28, and at the transferring region, only the transferring electric field that is defined by the dielectric layer 28 can be used. Here, the void may be formed not on the entire region of the back surface of the dielectric layer 28, but on one portion thereof, and they are not intended to be limited to fine recesses formed by a foamed material; they may be formed by machining the surface of the semiconductive layer 27 so as to provide recesses and protrusions.

In such a construction having void as described above, however, when the coefficient of thermal expansion is greater in the semiconductive layer 27 than in the dielectric layer 28, wrinkles tend to occur due to distortion of the transfer drum 11. Therefore, the coefficient of thermal expansion of the semiconductive layer 27 is set greater than that of the dielectric layer 28. With this construction which shrinks upon generation of heat, the occurrence of the wrinkles is easily prevented, and it is possible to avoid undesired attracting and transferring processes, and also to provide a stable contact upon cleaning process.

EMBODIMEN 2

Figure 21:
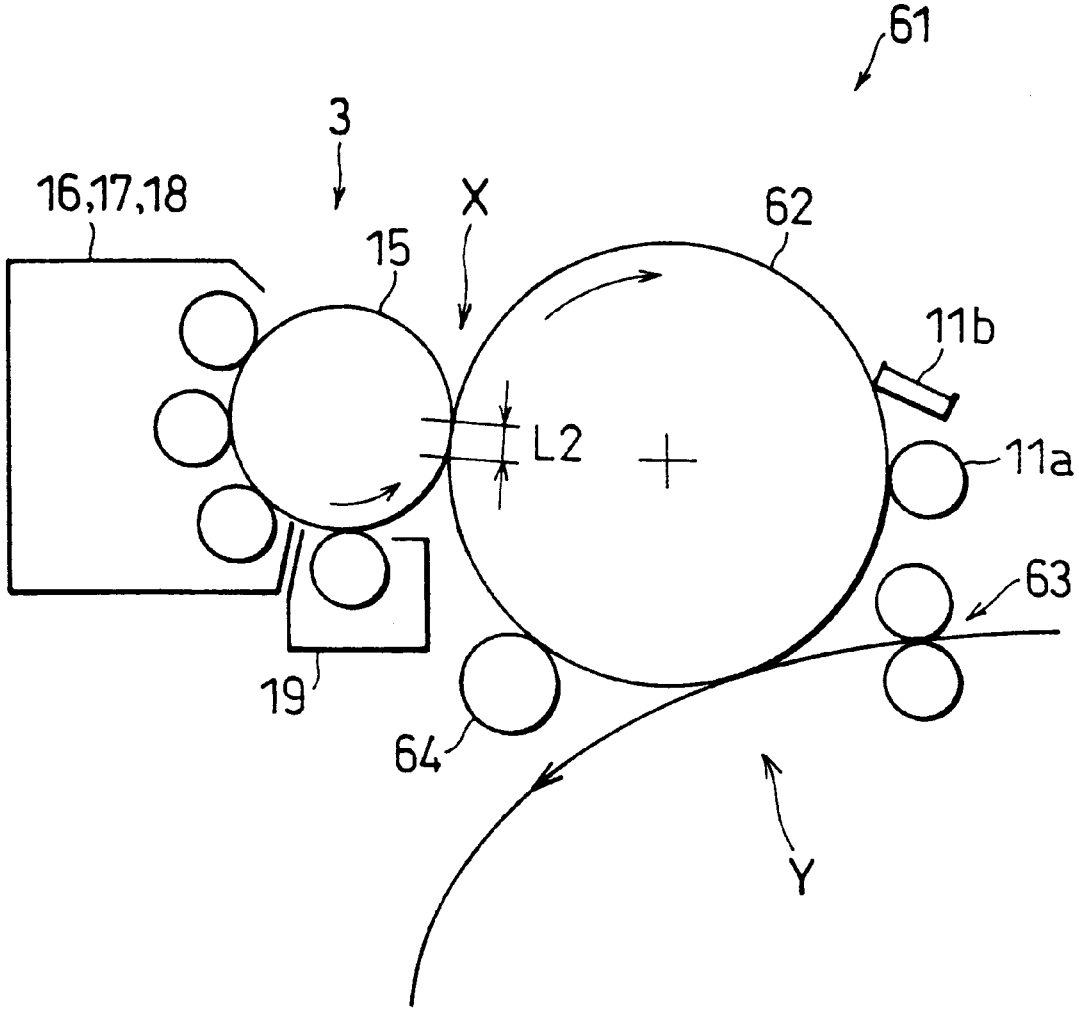
FIG. 21 is an explanatory drawing that shows the nip width between an intermediate transfer drum and the photoconductor drum in an image-forming apparatus in accordance with the second embodiment of the present invention.

Referring to FIG. 21, the following description will discuss the second embodiment of the present invention. Here, for convenience of explanation, those members that are described in the aforementioned embodiment by reference to Figures are indicated by the same reference numerals and the description thereof is omitted.

As illustrated in FIG. 21, the image-forming apparatus of the present Embodiment is provided with a transfer section 61 in place of the transfer section 2 in Embodiment 1, and the other arrangements are the same as those of Embodiment 1.

In the transfer section 61, an intermediate transfer drum 62 (an intermediate transfer means), which successively transfers toner images formed on the photoconductor drum 15 in an overlapping manner at transfer position X, is provided. The intermediate transfer drum 62 has the same construction as that of the transfer drum 11 on Embodiment 1.

On the periphery of the intermediate transfer drum 62, a roller charger 64, which electrically charges the intermediate drum 62 prior to transfer of the toner images from the photoconductive drum 15, is installed. The roller charger 64 is grounded or connected to a power supply. Here, a corona charger may be used instead of the roller charger 64.

Further, on the periphery of the intermediate transfer drum 62, a paper-feed roller 63, which carries the copying material and allows it to contact transfer position Y on the intermediate transfer drum 62, is installed. At transfer position Y, toner images on the intermediate transfer drum 62 are transferred onto the copying material all at once by applying a bias voltage to the intermediate transfer drum 62. Additionally, with respect to transfer means except for those using a bias voltage, those transfer means using a charge that is applied from the back surface (the opposite side to the intermediate transfer drum 62 side) or using a roller have been known.

Moreover, on the periphery of the intermediate transfer drum 62, a cleaning device **11*b* which removes residual toner adhering to the intermediate transfer drum 62 after the toner images have been transferred onto the copying material, and a static eliminating device 11***a*, which eliminates residual charge from the dielectric layer of the intermediate transfer drum 62, are installed.

In the case when the intermediate transfer drum 62 is used, since the intermediate transfer drum 62 with high resistance repeatedly contacts the photoconductor drum 15, the surface electric potential of the intermediate transfer drum 62 tends to change, resulting in an offset in the effective electric potential difference from the correct value.

For this reason, in the image-forming apparatus of the present embodiment, the transfer section 61 is designed to satisfy the following inequality:

$$\tau > L2/Vp.$$

Here, L2 represents the nip width formed by the contact between the intermediate transfer drum 62 and the photoconductor drum 15, Vp represents the rotation speed of the intermediate transfer drum 62 and the photoconductor drum 15, and $\tau$ represent the time constant of the intermediate transfer drum 62.

The time constant $\tau$ is represented by:

$$\tau = CR = \epsilon\epsilon_0\rho.$$

Here, R represents the resistance of the intermediate transfer drum 62, C represents the capacitance of the intermediate transfer drum 62, and $\epsilon$ represents the dielectric constant of the intermediate transfer drum 62, $\epsilon_0$ represents the dielectric constant of vacuum, and $\rho$ represents the volume resistivity of the intermediate transfer drum 62. In this case also, the same measuring method for the time constant $\tau$ as Embodiment 1 is adopted. the same as that used in Embodiment 1.

As described above, since the transfer section 61 is designed so that it satisfies the above-mentioned conditions, that is, so that the time (L2/Vp) required for the surface of the intermediate transfer drum 62 to move the nip width L2 is set smaller than the time constant $\tau$, the intermediate transfer drum 62 can be treated as a dielectric within the nip width L2. Therefore, the toner-holding electric field, exerted between the intermediate transfer drum 62 and the photoconductor drum 15, does not vary within the nip width L2; and at least within the nip width L2, it is possible to obtain a stable toner-holding electric field. In particular, when $\tau > 10 \times (L2/Vp)$ is satisfied, it has been proved through calculations that the intermediate transfer drum 62 can be completely treated as an insulator within the nip width L2; thus, it is possible to obtain a further stable toner-holding electric field. In this case, supposing that the rotation speed Vp is 85 mm/second and the nip width L2 is approximately 3 mm, the time (L2/Vp) is 0.035 second.

As described above, the present image-forming apparatus makes it possible to carry out a desired toner transferring process even if different kinds of copying material P are used. Further, even if a transfer drum 62 made of inexpensive materials is used, a desired transferring process can be carried out as long as the above-mentioned relationship is satisfied; thus, it is possible to achieve a low cost image-forming apparatus.

EMBODIMEN 3

Figure 22:
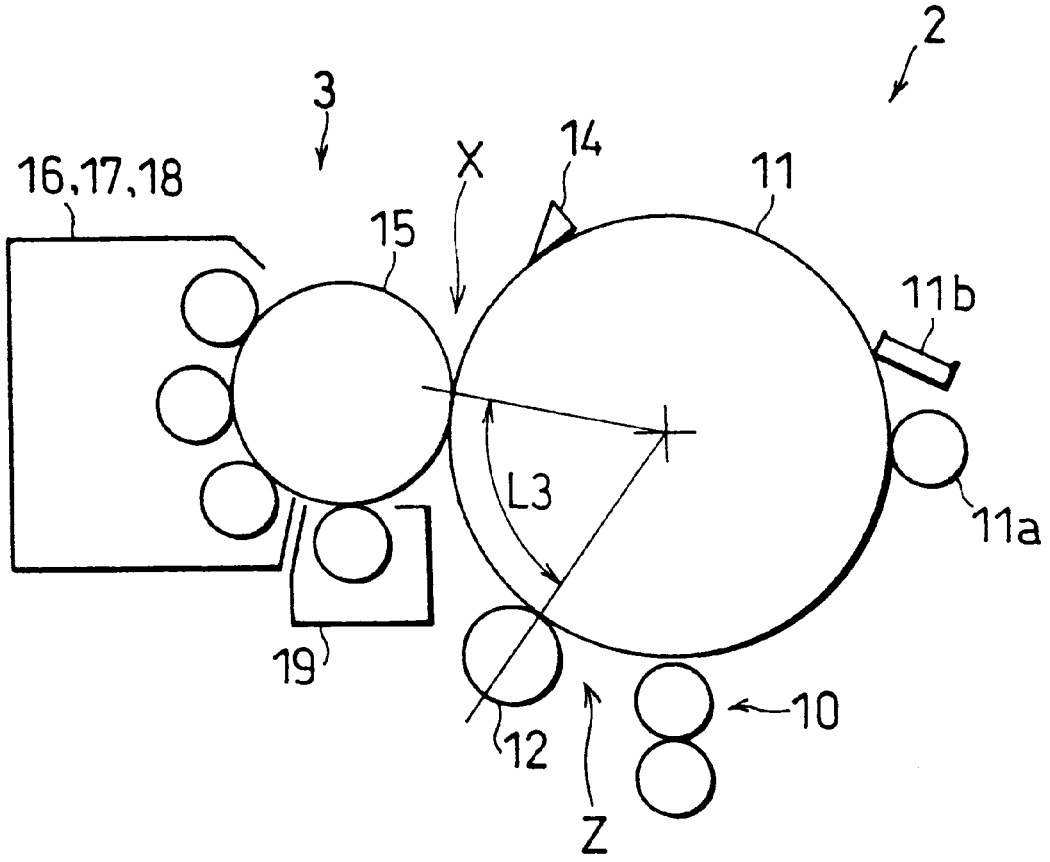
FIG. 22 is an explanatory drawing that shows the distance from the transferring position to the attracting position in an image-forming apparatus in accordance with the third embodiment of the present invention.

Referring to FIG. 22, the following description will discuss the third embodiment of the present invention. Here, for convenience of explanation, those members that are described in the aforementioned embodiment by reference to Figures are indicated by the same reference numerals and the description thereof is omitted.

As illustrated in FIG. 22, the image-forming apparatus of the present embodiment is provided with a transfer section 2 that has the same construction as that of Embodiment 1.

In the image-forming apparatus of the present embodiment, the transfer section 2 is designed to satisfy the following inequality:

$$\tau > L3/Vp.$$

Here, L3 represents the distance from transferring position X formed by the contact between the transfer drum 11 and the photoconductor drum 15 to attracting position Z formed by the contact between the transfer drum 11 and the ground roller 12, the distance being on the transfer drum 11; Vp represents the rotation speed of the transfer drum 11 and the photoconductor drum 15, and $\tau$ represent the time constant of the transfer drum 11. In this case also, the definition and measuring method of the time constant $\tau$ are the same as those of Embodiment 1.

As described above, since the photoconductor drum 15, the transfer drum 11 and the ground roller 12 are designed so that they satisfy the above-mentioned conditions, that is, so that the time (L3/Vp) required for the surface of the transfer drum 11 to move the distance L3 is set smaller than the time constant $\tau$, the transfer drum 11 can be treated as a dielectric within the distance L3. Therefore, the electric potential of the copying material, charged by the ground roller 12, is maintained, and the attracting and holding electric field does not vary within the distance L3, making it possible to provide a stable attracting and holding electric field. In particular, when $\tau > 10 \times (L3/Vp)$ is satisfied, it has been proved through calculations that the transfer drum 11 can be completely treated as an insulator within the distance L3; thus, it is possible to obtain a further stable attracting and holding electric field. In this case, supposing that the rotation speed Vp is 85 mm/second and the distance L3 is approximately 40 mm, the time (L3/Vp) is 0.5 second.

As described above, the present image-forming apparatus makes it possible to provide a desired copying-material attracting process even if different kinds of copying material are used. Further, even if a transfer drum 11 made of inexpensive materials is used, a desired attracting process can be carried out as long as the above-mentioned relationship is satisfied; thus, it is possible to achieve a low cost image-forming apparatus.

EMBODIMENT 4

Figure 23:
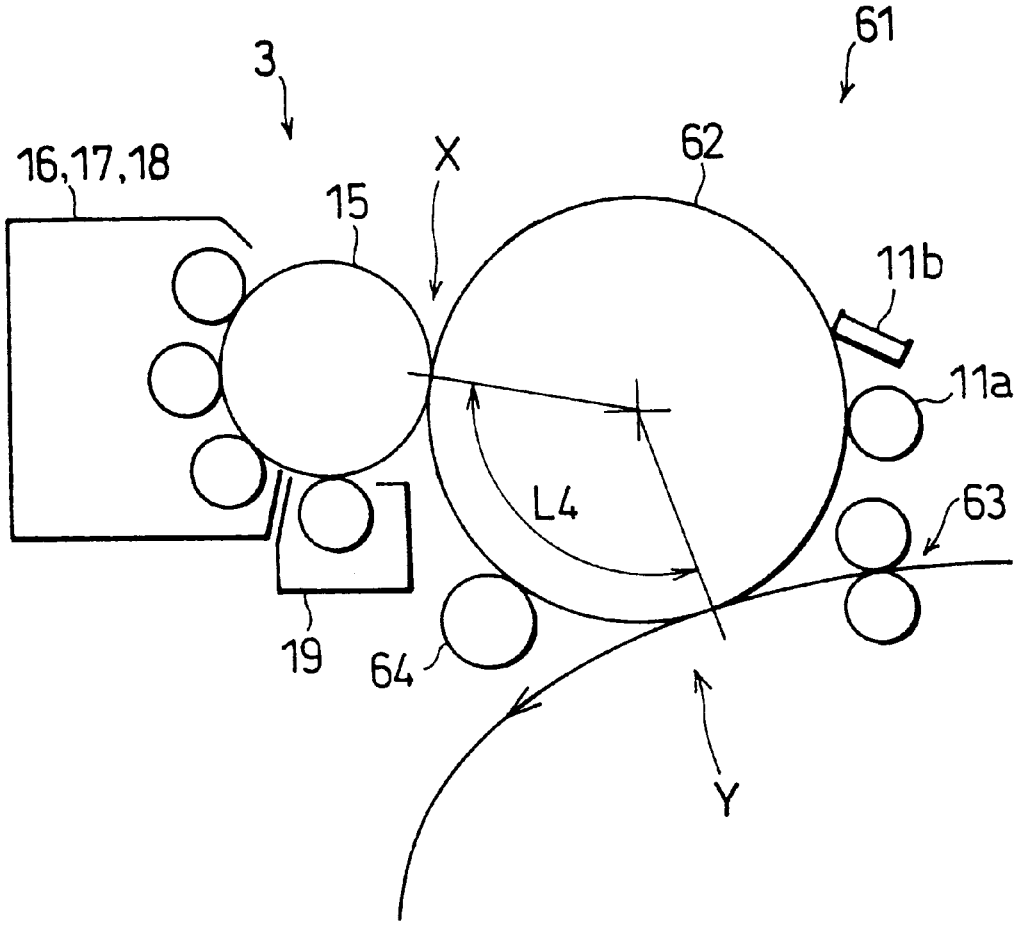
FIG. 23 is an explanatory drawing that shows the distance from the first transferring position to the second transferring position in an image-forming apparatus in accordance with the fourth embodiment of the present invention.

Referring to FIG. 23, the following description will discuss the fourth embodiment of the present invention. Here, for convenience of explanation, those members that are described in the aforementioned embodiment by reference to Figures are indicated by the same reference numerals and the description thereof is omitted.

As illustrated in FIG. 23, the image-forming apparatus of the present embodiment is provided with a transfer section 61 that has the same construction as that of Embodiment 2.

In the image-forming apparatus of the present embodiment, the transfer section 61 is designed to satisfy the following inequality:

$$\tau > L4/Vp.$$

Here, L4 represents the distance from transferring position X (the first transferring position) formed by the contact between the intermediate transfer drum 62 and the photoconductor drum 15 to transferring position Y (the second transferring position), the distance being on the intermediate transfer drum 62; Vp represents the rotation speed of the intermediate transfer drum 62 and the photoconductor drum 15, and $\tau$ represent the time constant of the intermediate transfer drum 62. In this case, the definition of the time constant $\tau$ is the same as that of Embodiment 2, and the measuring method for the time constant $\tau$ is the same as that of Embodiment 1.

As described above, since the transfer section 61 is designed so that it satisfies the above-mentioned conditions, that is, so that the time (L4/Vp) required for the surface of the intermediate transfer drum 62 to move the distance L4 is set smaller than the time constant $\tau$, the intermediate transfer drum 62 can be treated as a dielectric within the distance L4. Therefore, the toner-holding electric field does not vary within the distance L4, making it possible to provide a stable toner-holding electric field. In particular, when $\tau>10\times(L4/Vp)$ is satisfied, it has been proved through calculations that the intermediate transfer drum 62 can be completely treated as an insulator within the distance L4; thus, it is possible to obtain a further stable toner-holding electric field. In this case, supposing that the rotation speed Vp is 85 mm/second and the distance L4 is approximately 40 mm, the time (L4/Vp) is 0.5 second.

As described above, the present image-forming apparatus makes it possible to provide a desired toner-holding process even if different kinds of copying material are used. Further, even if an intermediate transfer drum 62 made of inexpensive materials is used, a desired toner-holding process can be carried out as long as the above-mentioned relationship is satisfied; thus, it is possible to achieve a low cost image-forming apparatus.

EMBODIMENT 5

Figure 24:
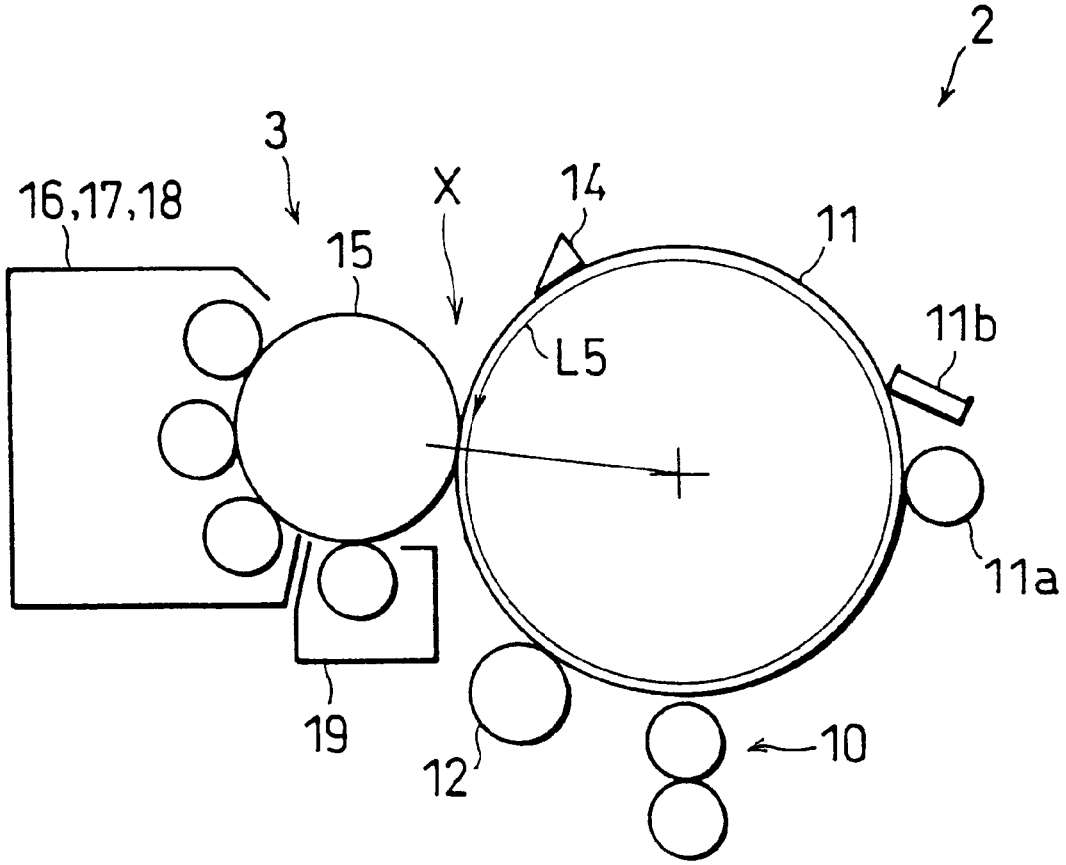
FIG. 24 is an explanatory drawing that shows the length of the circumference of the transfer drum in an image-forming apparatus in accordance with the fifth embodiment of the present invention.

Referring to FIG. 24, the following description will discuss the fifth embodiment of the present invention. Here, for convenience of explanation, those members that are described in the aforementioned embodiment by reference to Figures are indicated by the same reference numerals and the description thereof is omitted.

As illustrated in FIG. 24, the image-forming apparatus of the present embodiment is provided with a transfer section 2 that has the same construction as that of Embodiment 1. Here, the thickness of the PVDF sheet for forming the dielectric layer of the transfer drum 11 is not limited to the range of 50 to 250 $\mu$m, and extended to a maximum of 1 mm.

In the image-forming apparatus of the present embodiment, the transfer section 2 is designed to satisfy the following inequality:

$$\tau>L5/Vp.$$

Here, L5 represents the distance required for a given point on the transfer drum 11 after passage of transferring position X to again pass through transferring position X (the circumference of the transfer drum 11); Vp represents the rotation speed of the transfer drum 11 and the photoconductor drum 15, and $\tau$ represents the time constant of the transfer drum 11. In this case, the definition and measuring method of the time constant $\tau$ are the same as those of Embodiment 1.

As described above, since the transfer section 2 is designed so that it satisfies the above-mentioned conditions, that is, so that the time (L5/Vp) required for the transfer drum 11 to rotate once is set smaller than the time constant $\tau$, the transfer drum 11 can be treated as a dielectric within L5/Vp. Therefore, the attracting and holding electric field does not vary within the distance L5, making it possible to provide a stable attracting and holding electric field. In particular, when $\tau>10\times(L5/Vp)$ is satisfied, it has been proved through calculations that the transfer drum 11 can be completely treated as an insulator within the distance L5; thus, it is possible to obtain a further stable attracting and holding electric field. in this case, supposing that the rotation speed Vp is 85 mm/second and the distance L5 is approximately 440 mm, the time (L5/Vp) is 5 second.

As described above, the present image-forming apparatus makes it possible to provide a desired copying-material attracting process even if different kinds of copying material are used. Further, even if a transfer drum 11 made of inexpensive materials is used, a desired attracting process can be carried out as long as the above-mentioned relationship is satisfied; thus, it is possible to achieve a low cost image-forming apparatus.

EMBODIMENT 6

Figure 25:
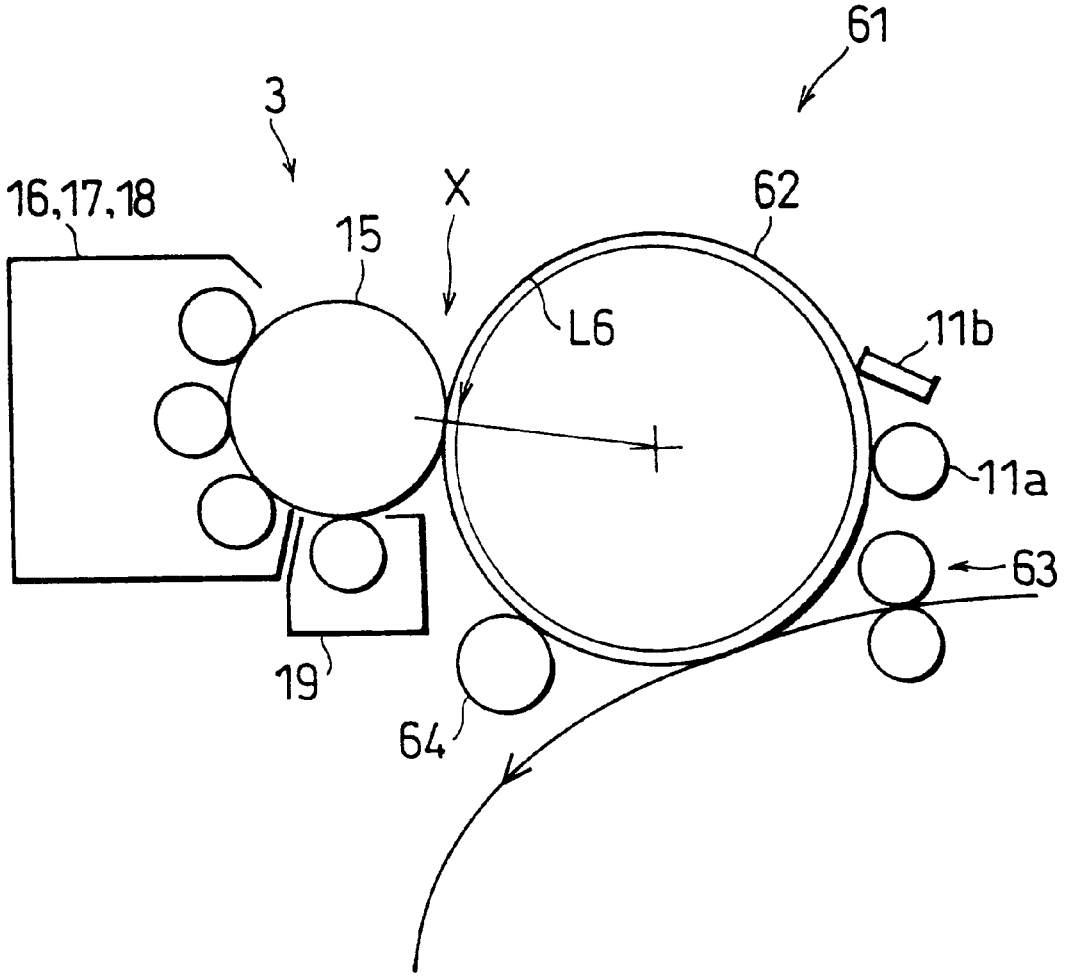
FIG. 25 is an explanatory drawing that shows the length of the circumference of the intermediate transfer drum in an image-forming apparatus in accordance with the sixth embodiment of the present invention.

Referring to FIG. 25, the following description will discuss the sixth embodiment of the present invention. Here, for convenience of explanation, those members that are described in the aforementioned embodiment by reference to Figures are indicated by the same reference numerals and the description thereof is omitted.

As illustrated in FIG. 25, the image-forming apparatus of the present embodiment is provided with a transfer section 61 that has the same construction as that of Embodiment 2.

In the image-forming apparatus of the present embodiment, the transfer section 61 is designed to satisfy the following inequality:

$$\tau>L6/Vp.$$

Here, L6 represents the distance required for a given point on the intermediate transfer drum 62 after passage of transferring position X to again pass through transferring position X (the circumference of the intermediate transfer drum 62); Vp represents the rotation speed of the intermediate transfer drum 62 and the photoconductor drum 15, and $\tau$ represents the time constant of the intermediate transfer drum 62. In this case, the definition of the time constant $\tau$ is the same as that of Embodiment 2, and the measuring method for the time constant $\tau$ is the same as that of Embodiment 1.

As described above, since the transfer section 61 is designed so that it satisfies the above-mentioned conditions, that is, so that the time (L6/Vp) required for the intermediate transfer drum 62 to rotate once is set smaller than the time constant $\tau$, the intermediate transfer drum 62 can be treated as a dielectric within L6/Vp. Therefore, the toner-holding electric field does not vary within the distance L6, making it possible to provide a stable toner-holding electric field. In particular, when $\tau>10\times(L6/Vp)$ is satisfied, it has been proved through calculations that the intermediate transfer drum 62 can be completely treated as an insulator within the distance L6; thus, it is possible to obtain a further stable toner-holding electric field. In this case, supposing that the rotation speed Vp is 85 mm/second and the distance L6 is approximately 40 mm, the time (L6/Vp) is 0.5 second.

As described above, the present image-forming apparatus makes it possible to provide a desired toner-holding process even if different kinds of copying material are used.

Further, even if an intermediate transfer drum 62 made of inexpensive materials is used, a desired toner-holding process can be carried out as long as the above-mentioned relationship is satisfied; thus, it is possible to achieve a low cost image-forming apparatus.

EMBODIMENT 7

Figure 26:
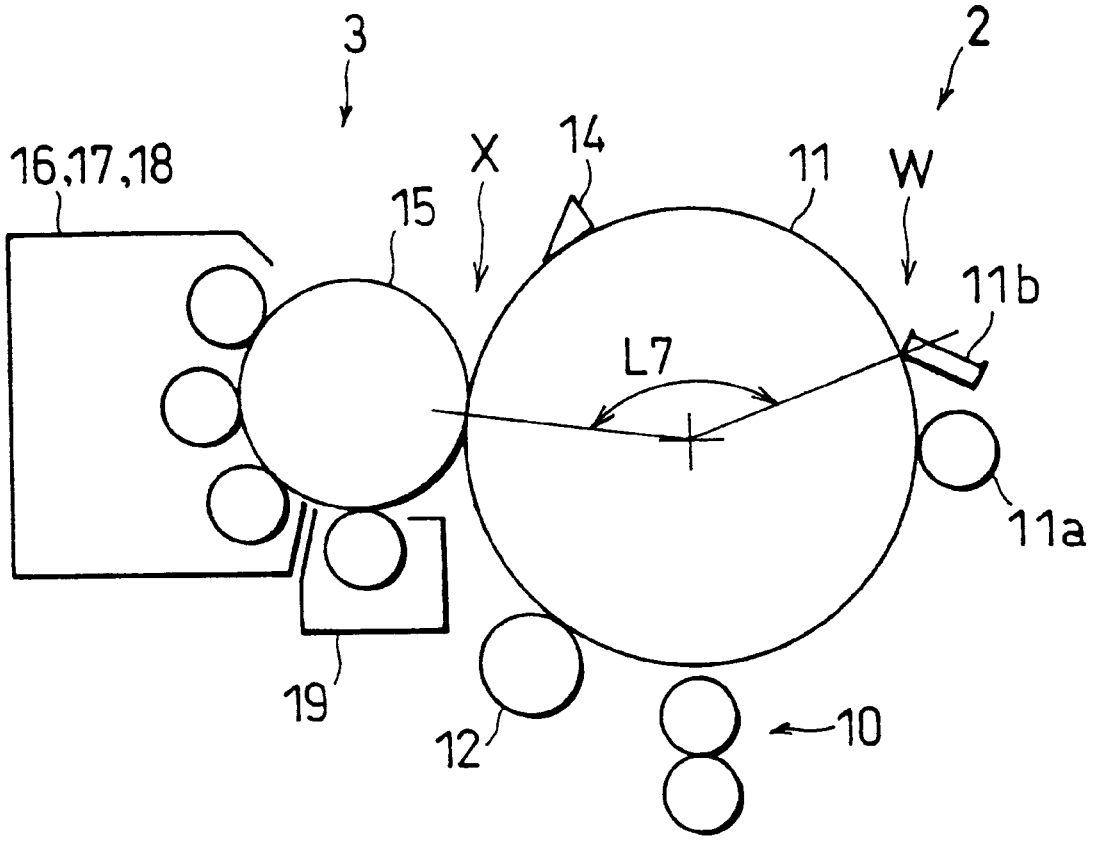
FIG. 26 is an explanatory drawing that shows the distance from the transferring position to the cleaning position in an image-forming apparatus in accordance with the seventh embodiment of the present invention.
Figure 27:
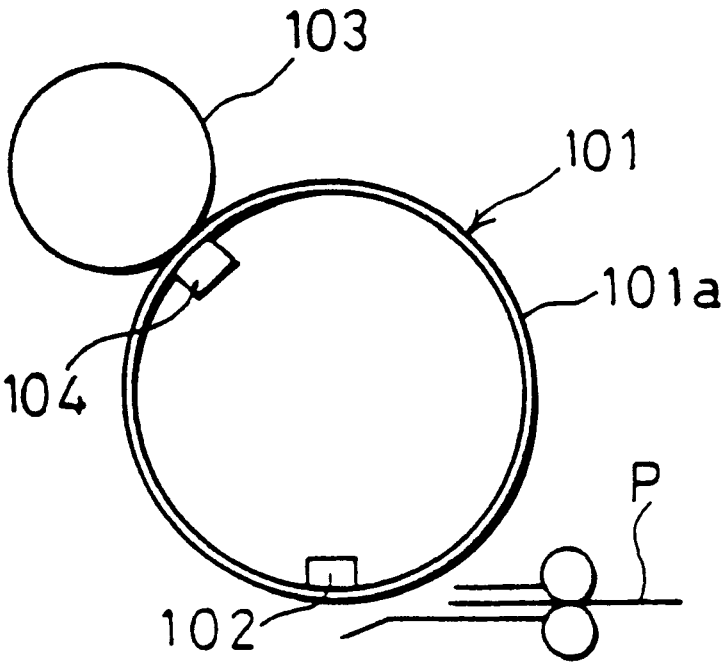
FIG. 27 PRIOR ART
FIG. 27 is a schematic view that shows the construction of a conventional image-forming apparatus.
Figure 28:
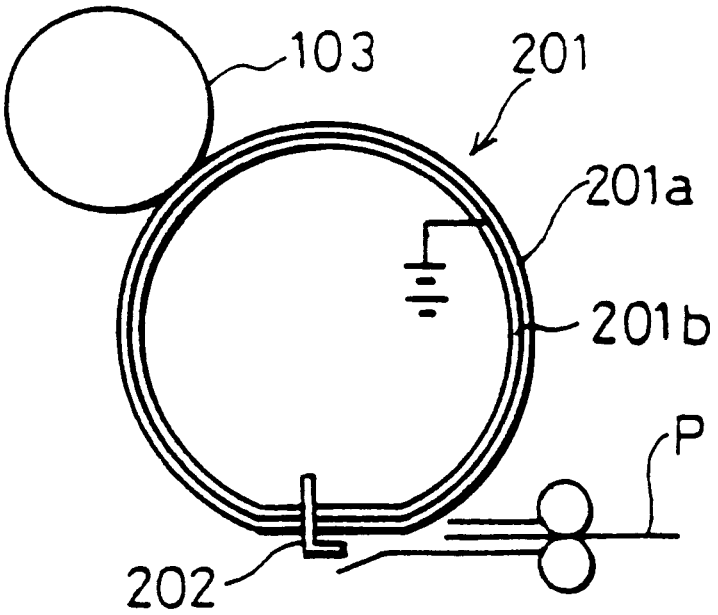
FIG. 28 PRIOR ART
FIG. 28 is a schematic view that shows the construction of another conventional image-forming apparatus.

Referring to FIG. 26, the following description will discuss the seventh embodiment of the present invention. Here, for convenience of explanation, those members that are described in the aforementioned embodiment by reference to Figures are indicated by the same reference numerals and the description thereof is omitted.

As illustrated in FIG. 26, the image-forming apparatus of the present embodiment is provided with a transfer section 2 that has the same construction as that of Embodiment 1. However, it is not necessary to install a static-eliminating device between transferring position X and cleaning position W.

In the image-forming apparatus of the present embodiment, the transfer section 2 is designed to satisfy the following inequality:

$$\tau < L7/Vp.$$

Here, L7 represents the distance from transferring position X formed by the contact between the photoconductor drum 15 and the transfer drum 11 to cleaning position W associated with the cleaning device 11*b*, the distance being on the transfer drum 11; Vp represents the rotation speed of the transfer drum 11 and the photoconductor drum 15, and $\tau$ represents the time constant of the transfer drum 11. In this case, the definition and measuring method of the time constant $\tau$ are the same as those of Embodiment 1.

As described above, since the transfer section 2 is designed so that it satisfies the above-mentioned conditions, that is, so that the time (L7/Vp) required for the surface of the transfer drum 11 to move the distance L7 is set greater than the time constant $\tau$, the transfer drum 11 can be treated as a dielectric within the distance L7. Therefore, unnecessary charges of the transfer drum 11, which include all those regarding the surface, interface, or trapping of the transfer drum 11, reduce within the distance L7. Consequently, when the residual toner has reached the cleaning device 11*b*, the toner adhering force is merely made up of an opposing charge and a physical adhering force.

Therefore, since it is not necessary to provide a static-eliminating device between transferring position X and cleaning position W, it is possible to achieve a compact apparatus.

EMBODIMENT 8

Figure 20:
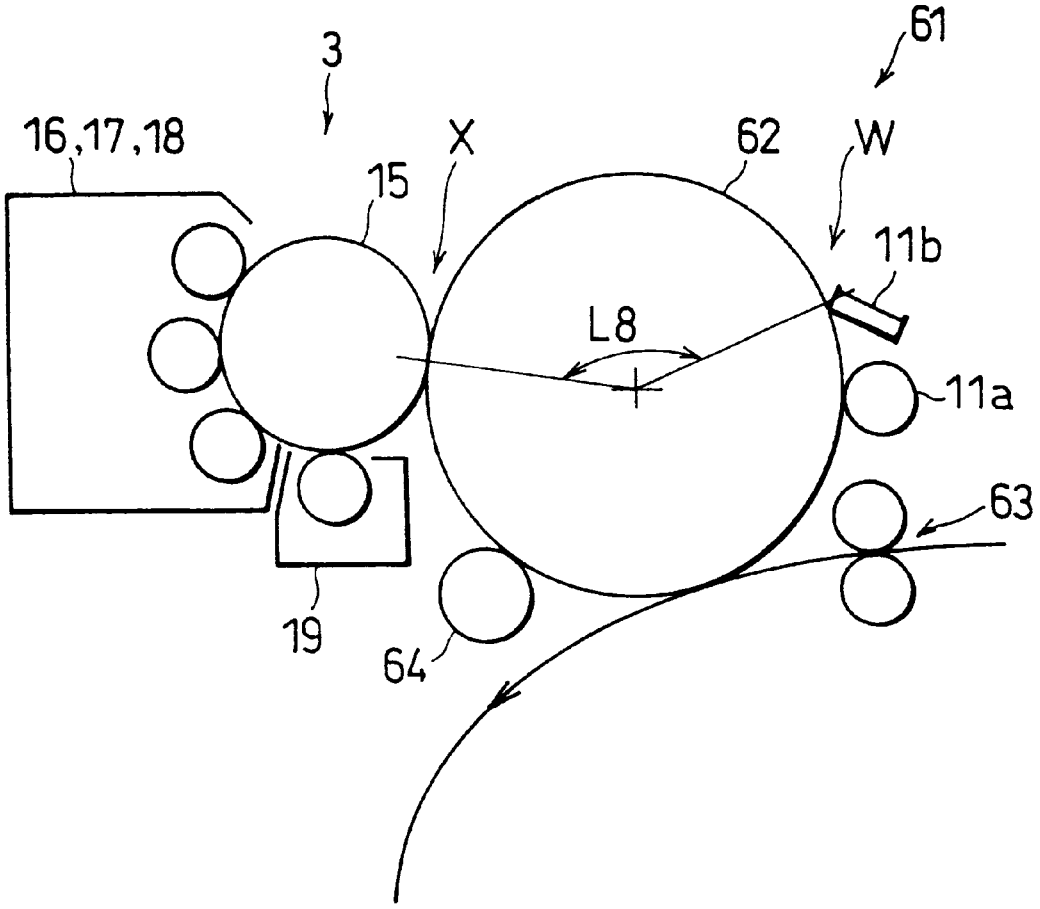
FIG. 20 is an explanatory drawing that shows the distance from the transferring position to the cleaning position in an image-forming apparatus in accordance with the eighth embodiment of the present invention.

Referring to FIG. 20, the following description will discuss the eighth embodiment of the present invention. Here, for convenience of explanation, those members that are described in the aforementioned embodiment by reference to Figures are indicated by the same reference numerals and the description thereof is omitted.

As illustrated in FIG. 20, the image-forming apparatus of the present embodiment is provided with a transfer section 61 that has the same construction as that of Embodiment 2. However, it is not necessary to install a static-eliminating device between transferring position X and cleaning position W.

In the image-forming apparatus of the present embodiment, the transfer section 61 is designed to satisfy the following inequality:

$$\tau < L8/Vp.$$

Here, L8 represents the distance from transferring position X formed by the contact between the photoconductor drum 15 and the intermediate transfer drum 62 to cleaning position W associated with the cleaning device 11*b*, the distance being on the intermediate transfer drum 62; Vp represents the rotation speed of the intermediate transfer drum 62 and the photoconductor drum 15; and $\tau$ represents the time constant of the intermediate transfer drum 62. In this case, the definition of the time constant $\tau$ is the same as that of Embodiment 2, and the measuring method for the time constant $\tau$ is the same as that of Embodiment 1.

As described above, since the intermediate transfer section 61 is designed so that it satisfies the above-mentioned conditions, that is, so that the time (L8/Vp) required for the surface of the intermediate transfer drum 62 to move the distance L8 is set greater than the time constant $\tau$; thus, unnecessary charges of the intermediate transfer drum 62, which include all those regarding the surface, interface, or trapping of the intermediate transfer drum 62, reduce within the distance L8. Consequently, when the residual toner has reached the cleaning device 11*b*, the toner adhering force is merely made up of an opposing charge and a physical adhering force.

Therefore, since it is not necessary to provide a static-eliminating device between transferring position X and cleaning position W, it is possible to achieve a compact apparatus.

EMBODIMENT 9

Figure 29:
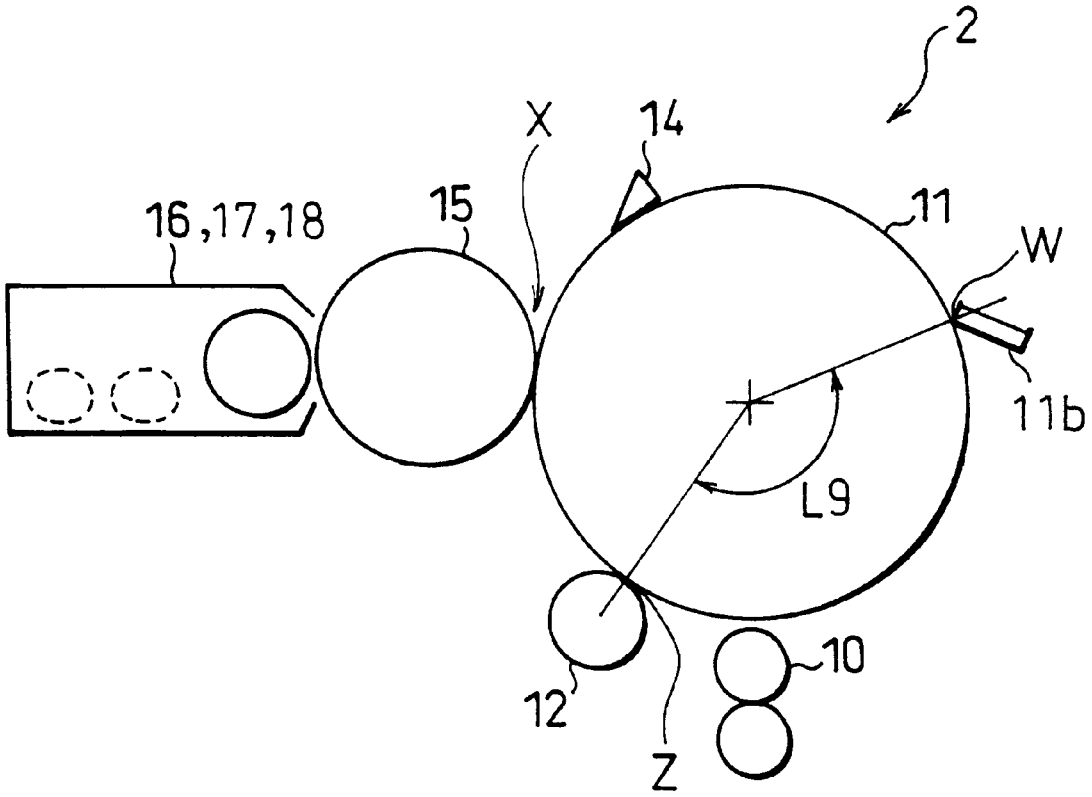
FIG. 29 is an explanatory drawing that shows the distance from the cleaning position to the attracting position in an image-forming apparatus in accordance with the ninth embodiment of the present invention.

Referring to FIG. 29, the following description will discuss the ninth embodiment of the present invention. Here, for convenience of explanation, those members that are described in the aforementioned embodiment by reference to Figures are indicated by the same reference numerals and the description thereof is omitted.

As illustrated in FIG. 29, the image-forming apparatus of the present embodiment is provided with a transfer section 2 that has the same construction as that of Embodiment 1. However, it is not necessary to install a static-eliminating device between transferring position X and cleaning position W.

Unnecessary charges remaining on the surface of the transfer drum 11 give adverse effects on the paper attracting process for the next copying material; therefore, in order to electrostatically attract the copying material onto the transfer drum 11 effectively, it is important to eliminate the unnecessary charges remaining on the transfer drum 11.

For this reason, in the image-forming apparatus of the present embodiment, the transfer section 2 is designed to satisfy the following inequality:

$$\tau < L9/Vp.$$

Here, L9 represents the distance on the transfer drum 11 from cleaning position W at which the cleaning device 11*b* works on the transfer drum 11 to attracting position Z at which the ground roller 12 contacts the transfer drum 11 as illustrated in FIG. 1; Vp represents the rotation speed of the transfer drum 11 and the photoconductor drum 15 (the surface speed); and $\tau$ represents the time constant of the transfer drum 11. In this case, the definition and measuring method of the time constant $\tau$ are the same as those Embodiment 1.

As described above, since the transfer section 2 is designed so that it satisfies the above-mentioned conditions, that is, so that the time it takes for a given point on the transfer drum 11 which has been cleaned by the cleaning device 11*b* to move the distance L9 to reach attracting position Z is set greater than the time constant $\tau$, residual unnecessary charges on the transfer drum 11, which include all those regarding the surface, interface, or trapping of the transfer drum 11, reduce within the travel to attracting position Z along the distance L9. Consequently, when the corresponding position has reached attracting position Z, only the predetermined charge exerted by the attracting and holding electric field between the transfer drum 11 and the ground roller 12 is allowed to remain.

Therefore, without installing the static-eliminating device, etc. at this position, the attracting electric potential is always maintained in a stable manner and the copying material can be stably attracted onto the dielectric layer 28 of the transfer drum 11, thereby making it possible to prevent the copying material from coming off the transfer drum 11 or being dislocated during transportation.

As described above, in the image-forming apparatus of the present embodiment, since the transfer section 2 is designed so that it satisfies the above-mentioned conditions, that is, so that the time (L9/Vp) required for the surface of the transfer drum 11 to move the distance L9 is set greater than the time constant $\tau$, unnecessary charges, which even include all those regarding the surface, interface, or trapping of the transfer drum 11, reduce within the distance L9. Therefore, when the corresponding position has again reached attracting position Z, the attracting process can be carried out using a correct attracting electric potential in a stable manner.

Additionally, in the above-mentioned Embodiments 1 through 9, the semiconductive layer 27 is made of foamed urethane; however, another foamed elastic resistor, which is adjusted so as to have a necessary resistance by blending conductive fine particles such as carbon into EPDM (ethylene-propylene-diene Copolymer Rubber) or silicone.

Moreover, besides the foamed elastic resistor, the semiconductive layer 27 may be constituted by another material made by using NBR (acrylonitrile-butadiene copolymer rubber), a mixture of NBR and SBR (styrenebutadiene rubber), a mixture of epichlorohydrine or other substance to which are blended conductive fine particles such as carbon. In this case, however, since void, which is formed by a foamed material, no longer exist between the semiconductive layer 27 and the dielectric layer 28, an increase in the attracting force, exerted by a discharge phenomenon in the void, is not available, but a uniform transferring electric field without electric-field changes is achieved; therefore, this construction is preferable when the transferring property would be desired rather than the attracting property.

Moreover, in the construction using a foamed material with high elasticity such as foamed urethane as described in Embodiment 9, when the transferring property would be desired rather than the attracting property, the recesses in the surface of the foamed elastic resistor layer may be filled with charge-protective grease such as Hicoat (:Brand name, manufactured by Sun Hayato Co., Ltd.) or other materials, so as to improve contacting property against the dielectric layer. In the case when a transfer drum having a pre-charge function for pre-charging from the surface of the dielectric layer 28, such a method makes it possible to stabilize the transferring property effectively.

Furthermore, in the above-mentioned Embodiments 1 through 9, the dielectric layer 28 is made of PVDF; however, in addition to this material, nylon 6, nylon 66, or a copolymer between PTFE (tetrafluoroethylene-perfluoroalkylvinyl ether copolymer resin) and urethane, or PET (polyethyleneterephthalate), or other materials may be adopted.

In the construction using a PVDF sheet as the dielectric layer 28, the thickness of the PVDF sheet was changed to 25 $\mu$m, 50 $\mu$m, 100 $\mu$m and 250 $\mu$m, and when the transferring performance was evaluated for each case with the dielectric constant $\epsilon$ being in the range of 7.0 to 14.0 and the volume resistivity $\rho$ being in the range of $1\times10^{9}$ to $1\times10^{15}$ $\Omega\cdot$cm; and in each case, a desired transferring performance of not less than 80% was obtained by adjusting the applied voltage.

Figure 19:
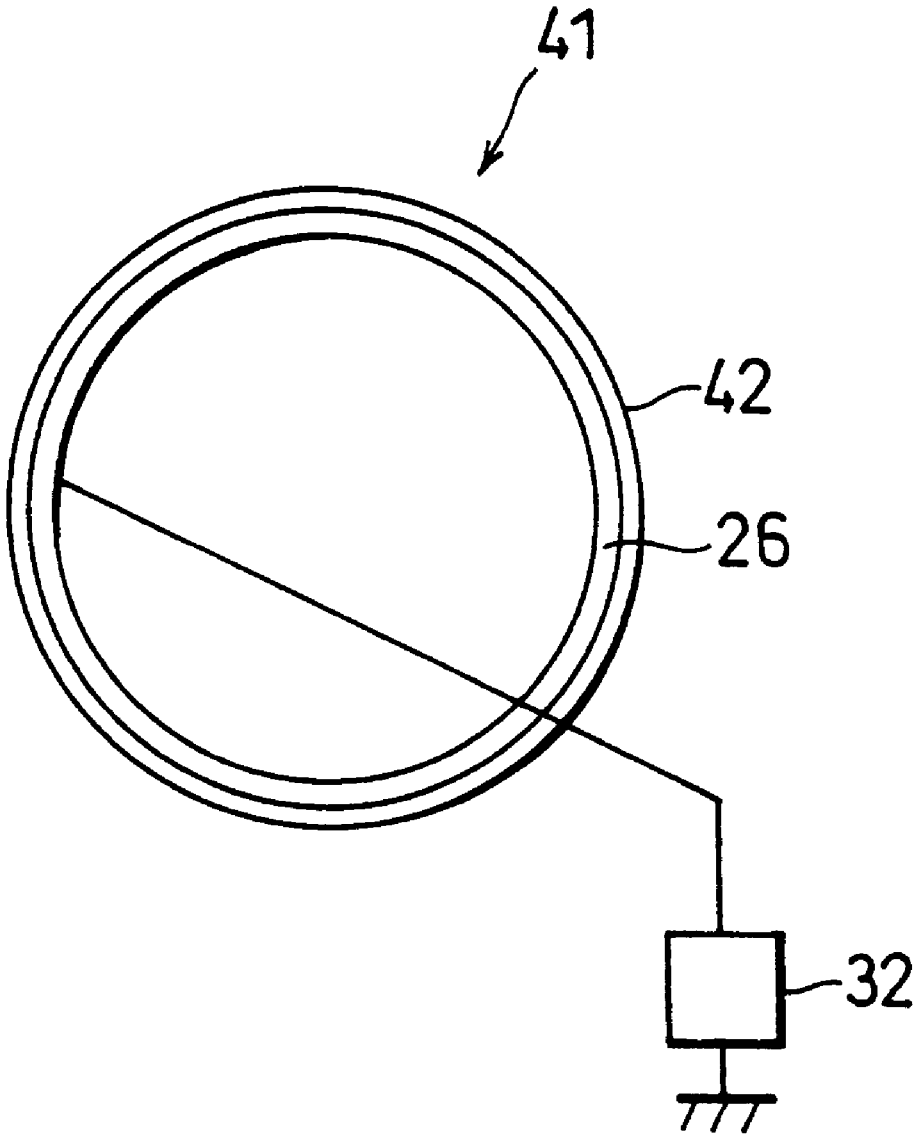
FIG. 19 is a view that shows the construction of another transfer drum provided in the image-forming apparatus of the present invention.

In the above-mentioned Embodiments 1 through 9, the transfer drum 11 (or the intermediate transfer drum 62) with a multi-layer structure having the semiconductive layer 27 and the dielectric layer 28 is used; however, as illustrated in FIG. 19, a mono-layer transfer drum 41 (or intermediate transfer drum), which has a conductor layer 26 provided as an inner layer and a dielectric layer 42 provided as an outer layer, may be adopted. In this case, the time constant is determined by adjusting the electric volume resistivity of the dielectric layer 42 in combination with the dielectric constant (approximately 10) of the dielectric layer 42. The transfer drum 41 of this type is formed as follows: For example, after blending SER into NBR so as to form the dielectric layer 42, this is cured, and then the surface is polished with paper or a grinder into a desired dimension. The transfer drum 41, which has a simple construction, makes it possible to reduce costs of the image-forming apparatus.

Moreover, the intermediate transfer drum 62, described in the above-mentioned Embodiments 2, 4, 6 and 8, may be designed to have the same construction as the transfer drum 11 as described above; however, it may also be constructed by bonding a high dielectric layer made of a material, such as PVDF, silicon, PE$\tau$, nylon and teflon, onto an aluminum base. Furthermore, instead of the construction using a drum, a belt may be adopted; and in this case, aluminum is vapor-deposited on the high dielectric layer or the layer is coated with conductive grease (Brand name: Hicoat; San Hayato Co., Ltd.)

Additionally, in the above-mentioned embodiments 1 through 8, the transfer drum 11 to which a voltage is applied and the ground roller 12 which is grounded are used; however, another construction, which has the transfer drum grounded and applies a voltage to the roller serving as the attracting means, may be adopted. In this case, in order to obtain an attracting process, the applied voltage to the roller is set not less than +300 V.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image-forming apparatus comprising:

an image-bearing body having a surface on which a toner image is formed;

transfer means for transferring the toner image formed on the image-bearing body onto a copying material by allowing the copying material to contact the image-bearing body the width of the contact being represented by L and the surface velocity or the image-bearing body being Vp, the transfer means being constituted by a dielectric layer that is stacked on a conductive base, the transfer means having a time constant $\tau$ equal to a product of the resistance and the capacitance between the image-bearing body and the transfer means so that the relationship represented by $L/Vp<\tau$ is satisfied; and attracting means for electrically attracting and holding the copying material onto the transfer means prior to transferring the toner image onto a copying material, the attracting means being placed on the periphery of the transfer means.

2. The image-forming apparatus as defined in claim 1, further comprising: at least a layer of an elastic resistor that is placed between the conductive base and the dielectric layer in the transfer means.

3. The image-forming apparatus as defined in claim 1, further comprising: at least a layer of an elastic resistor that is placed between the conductive base and the dielectric layer in the transfer means, with a clearance being formed between the elastic resistor layer and the dielectric layer.

4. The image-forming apparatus as defined in claim 3, wherein the coefficient of thermal expansion of the elastic resistor layer is set greater than the coefficient of thermal expansion of the dielectric layer.

5. An image-forming apparatus comprising:

an image-bearing body having a surface on which a toner image is formed:

intermediate transfer means on which the toner image formed on the image-bearing body is temporarily electrostatically transferred, the intermediate transfer means being constituted by a dialectric layer that is stacked on a conductive base; and transfer means for electrostatically transferring the toner image that has been temporarily transferred onto the intermediate transfer means onto a copying material, wherein the width of a contact portion formed by the contact between the image-bearing body and the intermediate transfer means is represented by L, the surface velocity of the image-bearing body and the intermediate transfer means is represented by Vp and the time constant of the intermediate transfer means, which is represented by a product of the resistance and the capacitance between the image-bearing body and the intermediate transfer means, is $\tau$ so that the relationship represented by $L/Vp<\tau$ is satisfied.

6. The image-forming apparatus as defined in claim 5, further comprising: at least a layer of an elastic resistor that is placed between the conductive base and the dielectric layer in the intermediate transfer means.

7. The image-forming apparatus as defined in claim 5, further comprising: at least a layer of an elastic resistor that is placed between the conductive base and the dielectric layer in the intermediate transfer means, with a clearance being formed between the elastic resistor layer and the dielectric layer.

8. The image-forming apparatus as defined in claim 7, wherein the coefficient of thermal expansion of the elastic resistor layer is set greater than the coefficient of thermal expansion of the dielectric layer.

9. An image-forming apparatus comprising:

an image-bearing body having a surface on which a toner image is formed;

transfer means, constituted by a dielectric layer that is stacked on a conductive base, for transferring the toner image formed on the image-bearing body onto a copying material by allowing the copying material electrostatically attracted onto the dielectric layer to contact the image-bearing body during the rotation thereof, attracting means for eelctrostatically attracting the copying material onto the dielectric layer, the attracting means being placed on the upstream side of the transferring position on the periphery of the transfer means; and cleaning means for removing residual toner from the surface of the transfer means after separation of the copying material, the cleaning means being placed on the downstream side of the transferring position on the periphery of the transfer means, wherein the distance on the circumferential surface of the transfer means from the cleaning position associated with the cleaning means to the attracting position associated with the attracting means is represented by L, the surface velocity of the image-bearing body and the transfer means is represented by Vp and the time constant of the transfer means, which is represented by a product of the resistance and the capacitance between the image-bearing body and the transfer means, is $\tau$, so that the relationship represented by $L/Vp>\tau$ is satisfied.

10. The image-forming apparatus as defined in claim 9, further comprising: at least a layer of an elastic resistor that is placed between the conductive base and the dielectric layer in the transfer means.

11. The image-forming apparatus as defined in claim 9, further comprising: at least a layer of an elastic resistor that is placed between the conductive base and the dielectric layer in the transfer means, with a clearance being formed between the elastic resistor layer and the dielectric layer.

12. The image-forming apparatus as defined in claim 11, wherein the coefficient of thermal expansion of the elastic resistor layer is set greater than the coefficient of thermal expansion of the dielectric layer.

13. An image-forming apparatus comprising:

an image-bearing body having a surface on which a toner image is formed;

transfer means for transferring the toner image formed on the image-bearing body onto a copying material by allowing the copying material to contact the image-bearing body, the transfer means being constituted by a dielectric layer that is stacked on a conductive base; and attracting means for electrically attracting and holding the copying material onto the transfer means prior to transferring the toner image onto the copying material, the attracting means being placed on the periphery of the transfer means, wherein the distance on the transfer means from the transferring position associated with the transfer means to the attracting position associated with the attracting means is represented by L, the surface velocity of the image-bearing body and the transfer means is represented by Vp and the time constant of the transfer means, which is represented by a product of the resistance and the capacitance between the image-bearing body and the transfer means, is $\tau$, so that the relationship represented by $L/Vp<\tau$ is satisfied.

14. An image-forming apparatus comprising:

an image bearing body having a surface on which a toner image is formed;

intermediate transfer means on which the toner image formed on the image-bearing body is temporarily electrostatically transferred, the intermediate transfer means being constituted by a dielectric layer that is stacked on a conductive base; and transfer means for electrostatically transferring the toner image that has been temporarily transferred onto the intermediate transfer means onto a copying material.

wherein the distance on the intermediate transfer means from the first transferring position at which the toner image is transferred from the image-bearing body onto the intermediate transfer means to the second transferring position at which the toner image is transferred from the intermediate transfer means to the copying material is represented by L, the surface velocity of the image-bearing body and the intermediate transfer means is represented by Vp and the time constant of the intermediate transfer means, which is represented by a product of the resistance and the capacitance between the image-bearing body and the intermediate transfer means, is $\tau$, so that the relationship represented by $L/Vp<\tau$ is satisfied.

15. An image-forming apparatus comprising:

an image-bearing body having a surface on which a toner image is formed;

transfer means for transferring the toner image formed on the image-bearing body onto a copying material by allowing the copying material to contact the image-bearing body, the transfer means being constituted by a dielectric layer that is stacked on a conductive base; and attracting means for electrically attracting and holding the copying material onto the transfer means prior to transferring the toner image onto the copying material, the attracting means being placed on the periphery of the transfer means, wherein the length of the circumference of the transfer means is represented by L, the surface velocity of the image-bearing body and the transfer means is represented by Vp and the time constant of the transfer means, which is represented by a product of the resistance and the capacitance between the image-bearing body and the transfer means, is $\tau$, so that the relationship represented by $L/Vp<\tau$ is satisfied.

16. An image-forming apparatus comprising:

an image-bearing body having a surface on which a toner image is formed;

intermediate transfer means on which the toner image formed on the image-bearing body is temporarily electrostatically transferred, the intermediate transfer means being constituted by a dielectric layer that is stacked on a conductive base; and transfer means for electrostatically transferring the toner image that has been temporarily transferred onto the intermediate transfer means onto a copying material, wherein the length of the circumference of the intermediate transfer means is represented by L, the surface velocity of the image-bearing body and intermediate transfer means is represented by Vp and the time constant of the intermediate transfer means, which is represented by a product of the resistance and the capacitance between the image-bearing body and the intermediate transfer means, is $\tau$, so that the relationship represented by $L/Vp<\tau$ is satisfied.

17. An image-forming apparatus comprising:

an image-bearing body having a surface on which a toner image is formed;

transfer means for transferring the toner image formed on the image-bearing body onto a copying material by allowing the copying material to contact the image-bearing body, the transfer means being constituted by a dielectric layer that is stacked on a conductive base; and cleaning means for removing residual toner from the surface of the transfer means after the toner image has been transferred onto the copying material, the cleaning means being placed on the periphery of the transfer means, wherein the distance on the transfer means from the transferring position associated with the transfer means to the cleaning position associated with the cleaning means is represented by L, the surface velocity of the image-bearing body and the transfer means is represented by Vp and the time constant of the transfer means, which is represented by a product of the resistance and the capacitance between the image-bearing body and the transfer means, is $\tau$, so that the relationship represented by $L/Vp>$is satisfied.

18. An image-forming apparatus comprising:

an image-bearing body having a surface on which a toner image is formed;

intermediate transfer means on which the toner image formed on the image-bearing body is temporarily electrostatically transferred, the intermediate transfer means being constituted by a dielectric layer that is stacked on a conductive base;

transfer means for electrostatically transferring the toner image that has been temporarily transferred onto the intermediate transfer means onto a copying material; and cleaning means for removing residual toner from the surface of the intermediate transfer means after the toner image has been transferred onto the copying material, the cleaning means being placed on the periphery of the intermediate transfer means.

wherein the distance on the intermediate transfer means from the transferring position at which the toner image is transferred from the image-bearing body to the intermediate transfer means to the cleaning position associated with the cleaning means is represented by L, the surface velocity of the image-bearing body and the intermediate transfer means is represented by Vp and the time constant of the intermediate transfer means, which is represented by a product of the resistance and the capacitance between the image-bearing body and the intermediate transfer means, is $\tau$, so that the relationship represented by $L/Vp>\tau$ is satisfied.

* * * * *

UNITED STATES PATENT AND TRADEMARK OFFICE

CERTIFICATE OF CORRECTION

PATENT NO. : 6,078,772
DATED : June 20, 2000
INVENTOR(S) : Takaya et al

It is certified that error appears in the above-identified patent and that said Letters Patent is hereby corrected as shown below:

On the title page: Item [56] Referenced Cited: should read

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS |
|---|---|---|---|---|---|---|---|---|---|---|---|---|
| | | 08 | 0 | 8 | 7 | 1 | 4 | 5A | 1996-04-02 | Japan | | |
| | | 07 | 3 | 3 | 9 | 5 | 7 | A2 | 1996-09-25 | EPO | | |
| | | 05 | 5 | 2 | 7 | 3 | 0 | A2 | 1993-07-28 | EPO | | |
| | | 6 | 4 | 7 | 4 | 5 | 7 | 1 | 1989-03-20 | Japan | | |
| | | | | | | | | | | | | |
| | | | | | | | | | | | | |
| | | | | | | | | | | | | |
| | | | | | | | | | | | | |

Signed and Sealed this

Seventh Day of November, 2000

*Attest:*

Q. TODD DICKINSON

*Attesting Officer*

*Director of Patents and Trademarks*